US008632317B2

(12) United States Patent
Headley

(10) Patent No.: US 8,632,317 B2
(45) **Date of Patent: *Jan. 21, 2014**

(54) AIR MOTOR HAVING A MODULAR ADD ON REGULATOR

(75) Inventor: Thomas R. Headley, Roanoke, IN (US)

(73) Assignee: Ingersoll-Rand Company, Davidson, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/574,971

(22) PCT Filed: Jan. 28, 2011

(86) PCT No.: PCT/US2011/023010

§ 371 (c)(1),
(2), (4) Date: Jul. 24, 2012

(87) PCT Pub. No.: WO2011/094603

PCT Pub. Date: Aug. 4, 2011

(65) Prior Publication Data

US 2012/0294745 A1 Nov. 22, 2012

Related U.S. Application Data

(60) Provisional application No. 61/299,828, filed on Jan. 29, 2010.

(51) Int. Cl.
*F04B 49/00* (2006.01)

(52) U.S. Cl.
USPC ..... 417/46; 417/245; 417/379; 137/625.15

(58) Field of Classification Search
USPC ..... 417/46, 245, 318, 375, 379, 384; 137/567.15, 625.15
See application file for complete search history.

(56) References Cited

U.S. PATENT DOCUMENTS

| | | | | |
|---|---|---|---|---|
| 4,181,066 | A | 1/1980 | Kitchen | |
| 4,355,761 | A * | 10/1982 | Bjorn et al. | 239/126 |
| 4,838,034 | A * | 6/1989 | Leonard et al. | 62/50.2 |
| 6,123,008 | A | 9/2000 | Scherer | |
| 6,722,256 | B2 | 4/2004 | Roberts | |
| 6,736,612 | B2 | 5/2004 | Gibbons | |

OTHER PUBLICATIONS

International Written Opinion for Application No. PCT/US2011/023010 dated Oct. 24, 2011 (3 pages).
International Preliminary Report on Patenability for Application No. PCT/US2011/023010 dated Aug. 9, 2012 (5 pages).
International Search Report and Written Opinion of PCT/US2011/023010, dated Oct. 24, 2011.

* cited by examiner

*Primary Examiner* — Charles Freay
*Assistant Examiner* — Patrick Hamo
(74) *Attorney, Agent, or Firm* — Michael Best & Friedrich LLP

(57) ABSTRACT

A pump assembly including an air motor includes a pressure regulator assembly connected to a motive fluid inlet of the air motor. The pressure regulator assembly has a housing that contains an actuator assembly, a ball valve assembly, a bleed valve, a first pressure adjustment assembly, and a second adjustment assembly. The housing includes a motive fluid inlet port, a pressure regulator outlet, a bleed valve port, an actuator support, a pressure adjustment chamber, and a ball valve chamber. The pressure regulator assembly includes at least one gauge that displays at least one measurement parameter.

12 Claims, 20 Drawing Sheets

AIR MOTOR HAVING A MODULAR ADD ON REGULATOR

CROSS REFERENCE TO RELATED APPLICATION

This application claims priority to U.S. Provisional Patent Application No. 61/299,828, filed Jan. 29, 2010, the entire contents of which are herein incorporated by reference.

BACKGROUND

The present invention relates to air motors and valves for a piston pump.

SUMMARY

In one embodiment, the invention provides an air motor having a motive fluid inlet (335) adapted to receive a flow of motive fluid; a cylinder (615); a piston (620) within the cylinder (615), the piston (620) dividing the cylinder (615) into an upper chamber (635) above the piston (620) and a lower chamber (640) below the piston (620); a valve chamber (355) including a pilot chamber portion (515); a spool valve (360) shiftable between first and second positions, the spool valve (360) including a reduced diameter section (480) and an enlarged diameter section (485), the enlarged diameter section (485) being exposed to the pilot chamber portion (515); a D-valve plate (375) including a first D-valve port (455) communicating with the upper chamber (635), a second D-valve port (460) communicating with the lower chamber (640), and a D-valve exhaust port (465) communicating with atmosphere; a D-valve (370) having a flat surface surrounding a concave surface (520), the flat surface being in sliding contact with the D-valve plate (375) and the concave surface (520) facing the D-valve plate (375), the D-valve (370) being coupled via a lost motion interconnection (525) to the reduced diameter section (480) of the spool valve (360), the D-valve (370) being shiftable with the spool valve (360) between first and second positions corresponding to the respective first and second positions of the spool valve (360), wherein the D-valve (370) uncovers the first D-valve port (455) when the D-valve (370) is in the first position to introduce motive fluid into the upper chamber (635), the concave surface (520) of the D-valve (370) placing the second D-valve port (460) in communication with the D-valve exhaust port (465) to place the lower chamber (640) in communication with the atmosphere when the D-valve (370) is in the first position, wherein the D-valve (370) uncovers the second D-valve port (460) when the D-valve (370) is in the second position to introduce motive fluid into the lower chamber (640), the concave surface (520) of the D-valve (370) placing the first D-valve port (455) in communication with the D-valve exhaust port (465) to place the upper chamber (635) in communication with the atmosphere when the D-valve (370) is in the second position; a pilot valve plate (385) including a first pilot port (470) communicating with the pilot chamber portion (515) and a second pilot port (475) communicating with atmosphere; a pilot valve (380) having a flat surface surrounding a concave surface (530), the flat surface being in sliding contact with the pilot valve plate (385) and the concave surface (530) facing the pilot valve plate (385), the pilot valve (380) being coupled to the reduced diameter section (480) of the spool valve (360), the pilot valve (380) being shiftable with the spool valve (360) between first and second positions corresponding to the respective first and second positions of the spool valve (360), wherein the pilot valve (380) uncovers the first pilot port (470) when the pilot valve (380) is in the first position to introduce motive fluid into the pilot chamber (515), and wherein the concave surface (530) of the pilot valve (380) places the first and second pilot ports (470, 475) in communication with each other to place the pilot chamber (515) in communication with the atmosphere when the pilot valve (380) is in the second position, wherein introduction of motive fluid into the pilot chamber (515) shifts the spool valve (360) to the first position, wherein exposing the pilot chamber (515) to atmosphere facilitates shifting the spool valve (360) to the second position; an actuation rod (625) having a first end (650) and a second end (660) opposite the first end (650), the first end (650) being interconnected by way of a lost motion connection (490, 655) to the spool valve (360), the second end (660) being interconnected by way of a lost motion connection (725, 665) to the piston (620), such that upward movement of the piston (620) assists the spool valve (360) moving from the second position toward the first position, and such that downward movement of the piston (620) assists the spool valve (360) moving from the first position to the second position; an output rod (710) interconnected for reciprocal movement with the piston (620) and adapted to perform work; and a pressure regulator assembly (210) adapted to be coupled to the motive fluid inlet (335), the pressure regulator assembly (210) having a housing (1225) containing an actuator assembly (1230), a ball valve assembly (1235), a bleed valve (1240), a first pressure adjustment assembly (1245), and a second adjustment assembly (1250), wherein the housing (1225) includes a motive fluid inlet port (1270), a pressure regulator outlet (1215), a bleed valve port (1275), an actuator support (1280), a pressure adjustment chamber (1285), and a ball valve chamber (1290), and wherein the pressure regulator assembly (210) includes at least one gauge that displays at least one measurement parameter.

In another embodiment, the invention provides a pump assembly including a motive fluid inlet (335) adapted to receive a flow of motive fluid; a cylinder (615); a piston (620) within the cylinder (615), the piston (620) dividing the cylinder (615) into an upper chamber (635) above the piston (620) and a lower chamber (640) below the piston (620); a valve chamber (355) including a pilot chamber portion (515); a spool valve (360) shiftable between first and second positions, the spool valve (360) including a reduced diameter section (480) and an enlarged diameter section (485), the enlarged diameter section (485) being exposed to the pilot chamber portion (515); a D-valve plate (375) including a first D-valve port (455) communicating with the upper chamber (635), a second D-valve port (460) communicating with the lower chamber (640), and a D-valve exhaust port (465) communicating with atmosphere; a D-valve (370) having a flat surface surrounding a concave surface (520), the flat surface being in sliding contact with the D-valve plate (375) and the concave surface (520) facing the D-valve plate (375), the D-valve (370) being coupled via a lost motion interconnection (525) to the reduced diameter section (480) of the spool valve (360), the D-valve (370) being shiftable with the spool valve (360) between first and second positions corresponding to the respective first and second positions of the spool valve (360), wherein the D-valve (370) uncovers the first D-valve port (455) when the D-valve (370) is in the first position to introduce motive fluid into the upper chamber (635), the concave surface (520) of the D-valve (370) placing the second D-valve port (460) in communication with the D-valve exhaust port (465) to place the lower chamber (640) in communication with the atmosphere when the D-valve (370) is in the first position, wherein the D-valve (370) uncovers the second D-valve port (460) when the D-valve (370) is in the second position to introduce motive fluid into the lower chamber (640), the concave surface (520) of the D-valve (370) placing the first D-valve port (455) in communication with the D-valve exhaust port (465) to place the upper chamber (635) in communication with the atmosphere when the D-valve (370) is in the second position; a pilot valve plate (385) including a first pilot port (470) communicating with the pilot chamber portion (515) and a second pilot port (475) communicating with atmosphere; a pilot valve (380) having a flat surface surrounding a concave surface (530), the flat surface being in sliding contact with the pilot valve plate (385) and the concave surface (530) facing the pilot valve plate (385), the pilot valve (380) being coupled to the reduced diameter section (480) of the spool valve (360), the pilot valve (380) being shiftable with the spool valve (360) between first and second positions corresponding to the respective first and second positions of the spool valve (360), wherein the pilot valve (380) uncovers the first pilot port (470) when the pilot valve (380) is in the first position to introduce motive fluid into the pilot chamber (515), and wherein the concave surface (530) of the pilot valve (380) places the first and second pilot ports (470, 475) in communication with each other to place the pilot chamber (515) in communication with the atmosphere when the pilot valve (380) is in the second position, wherein introduction of motive fluid into the pilot chamber (515) shifts the spool valve (360) to the first position, wherein exposing the pilot chamber (515) to atmosphere facilitates shifting the spool valve (360) to the second position; an actuation rod (625) having a first end (650) and a second end (660) opposite the first end (650), the first end (650) being interconnected by way of a lost motion connection (490, 655) to the spool valve (360), the second end (660) being interconnected by way of a lost motion connection (725, 665) to the piston (620), such that upward movement of the piston (620) assists the spool valve (360) moving from the second position toward the first position, and such that downward movement of the piston (620) assists the spool valve (360) moving from the first position to the second position; an output rod (710) interconnected for reciprocal movement with the piston (620); a piston pump (120) including a pump cylinder (170), an outlet (175), and a one-way valve supported for reciprocation within the pump cylinder (170) and operable to move fluid from below the one-way valve toward the outlet (175), the one-way valve being interconnected with the output rod (710) to cause reciprocation of the one-way valve to move a fluid to be pumped from within the cylinder (170) out the outlet (175) to a desired destination; and a pressure regulator assembly (210) adapted to be coupled to the motive fluid inlet (335), the pressure regulator assembly (210) having a housing (1225) containing an actuator assembly (1230), a ball valve assembly (1235), a bleed valve (1240), a first pressure adjustment assembly (1245), and a second adjustment assembly (1250), wherein the housing (1225) includes a motive fluid inlet port (1270), a pressure regulator outlet (1215), a bleed valve port (1275), an actuator support (1280), a pressure adjustment chamber (1285), and a ball valve chamber (1290), and wherein the pressure regulator assembly (210) includes at least one gauge that displays at least one measurement parameter.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
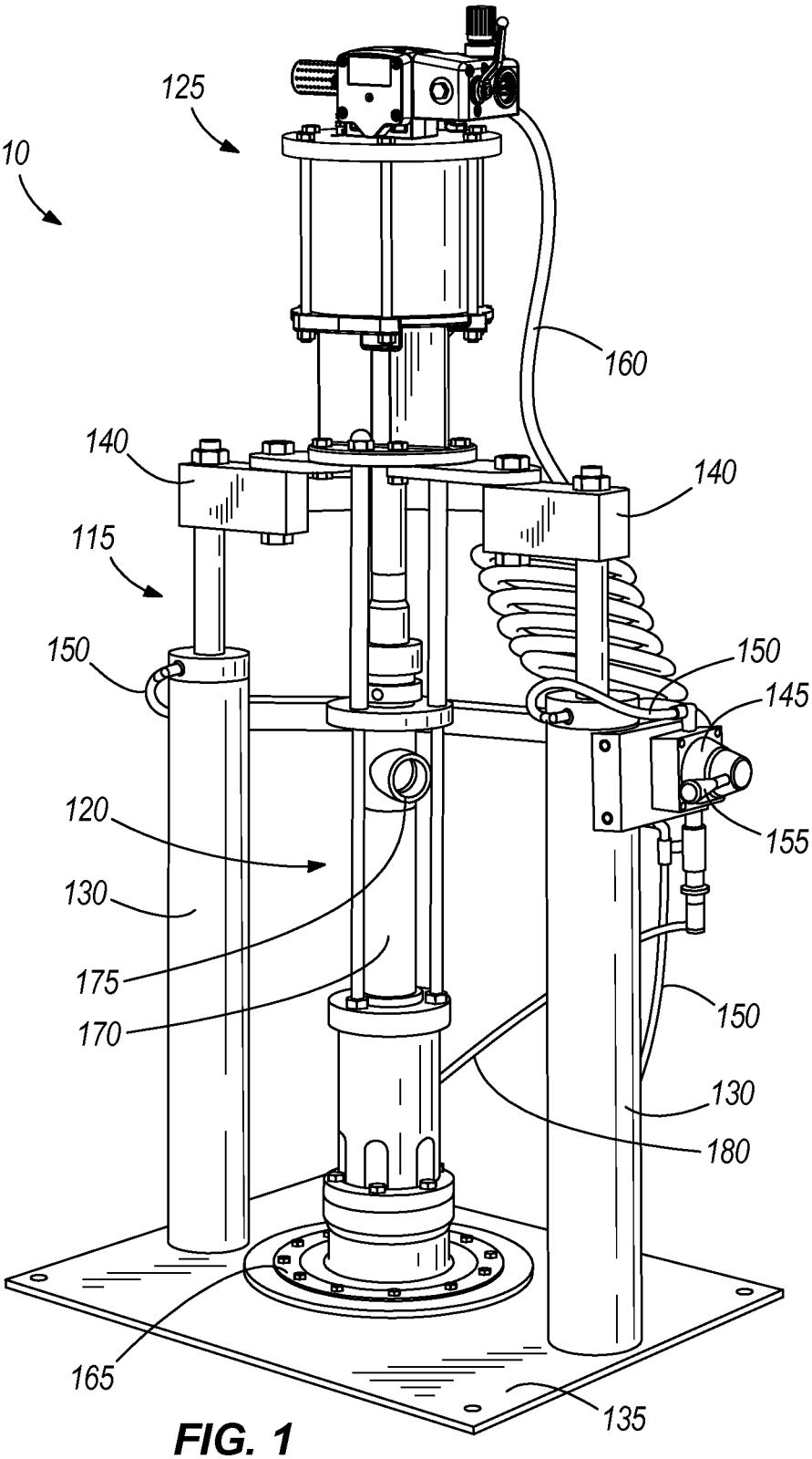
FIG. 1 is a perspective view of a piston pump according to some embodiments of the present invention.

FIG. 1 illustrates a piston pump assembly 110 according to one embodiment of the present invention. The piston pump assembly 110 includes a stand 115, a piston pump 120, and an air motor 125. The stand 115 includes first and second rams 130 and a base plate 135. The air motor 125 and piston pump 120 are mounted to support blocks 140 at the top of each of the rams 130. The air motor 125 is above the support blocks 140 and the piston pump 120 is below the support blocks 140, directly beneath the air motor 125.

A supply of motive fluid 145 communicates with the top and bottom end of each of the first and second rams 130 via ram hoses 150. In this disclosure, the term "motive fluid" means any fluid that is used to perform work. Motive fluid includes but is not limited to compressed air. A control handle 155 on the supply of motive fluid 145 is used to direct motive fluid to either the bottom end of the rams 130 or the top end of the rams 130, to respectively raise and lower the air motor 125 and piston pump 120 with respect to the base plate 135. Motive fluid is provided to the air motor 125 from the supply of motive fluid 145 via a motor hose 160. The air motor 125 operates under the influence of the motive fluid to operate the piston pump 120.

The piston pump 120 includes a wiper assembly 165, a pump cylinder 170, and an outlet 175. In operation, the rams 130 are raised such that the wiper assembly 165 is lifted a sufficient distance off the base plate 135 to accommodate a container of fluid to be pumped. The wiper assembly 165 is sized to fit within the container of fluid (e.g., a 5-gallon bucket, a barrel, or other container). When it is time to pump the fluid out of the container, the rams 130 are permitted to lower under the influence of gravity or are actively lowered by motive fluid being supplied to the tops of the rams 130. As the rams 130 are lowered, the wiper assembly 165 is pushed down into the container, with the wiper 165 pushing down on the fluid to be pumped. This feeds the fluid to be pumped into the pump cylinder 170.

At the same time as the rams 130 are lowered, motive fluid is supplied to the air motor 125 and the air motor 125 drives operation (i.e., reciprocation) of the piston pump 120. Within the pump cylinder 170, a one-way valve reciprocates under the influence of the air motor 125 to force fluid up to the outlet 175. From the outlet 175, the fluid to be pumped is directed by hoses or other conduits to a desired destination. Once the wiper 165 has bottomed out in the container, or it is otherwise desired to raise the wiper 165 out of the container, the supply of motive fluid 145 provides motive fluid into the container under the wiper 165 by way of a hose 180. This supply of motive fluid to the container permits the wiper 165 to be extracted from the container without creating a vacuum in the container that might lift the container.

Figure 2:
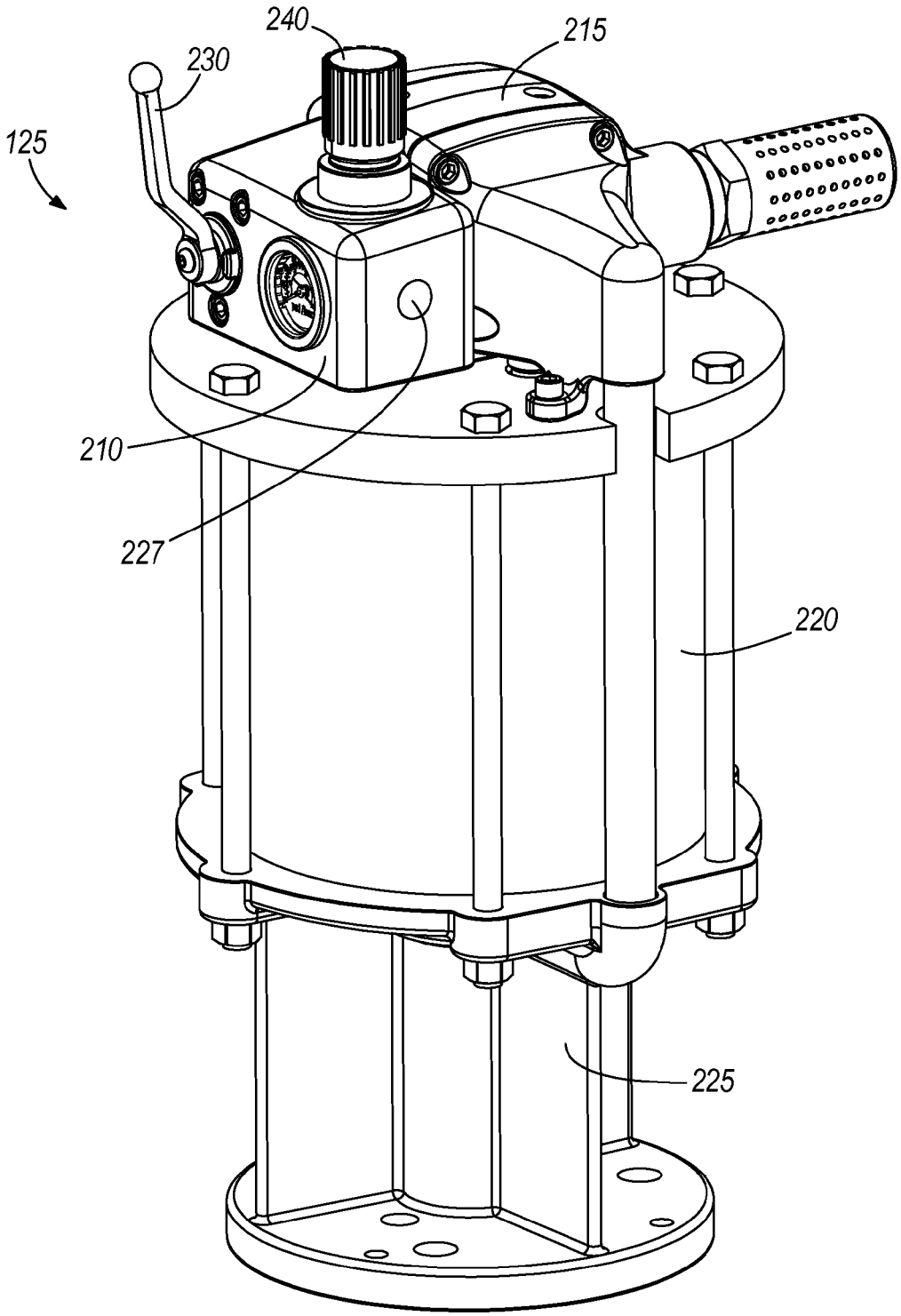
FIG. 2 is a perspective view of an air motor of the piston pump of FIG. 1.
Figure 3:
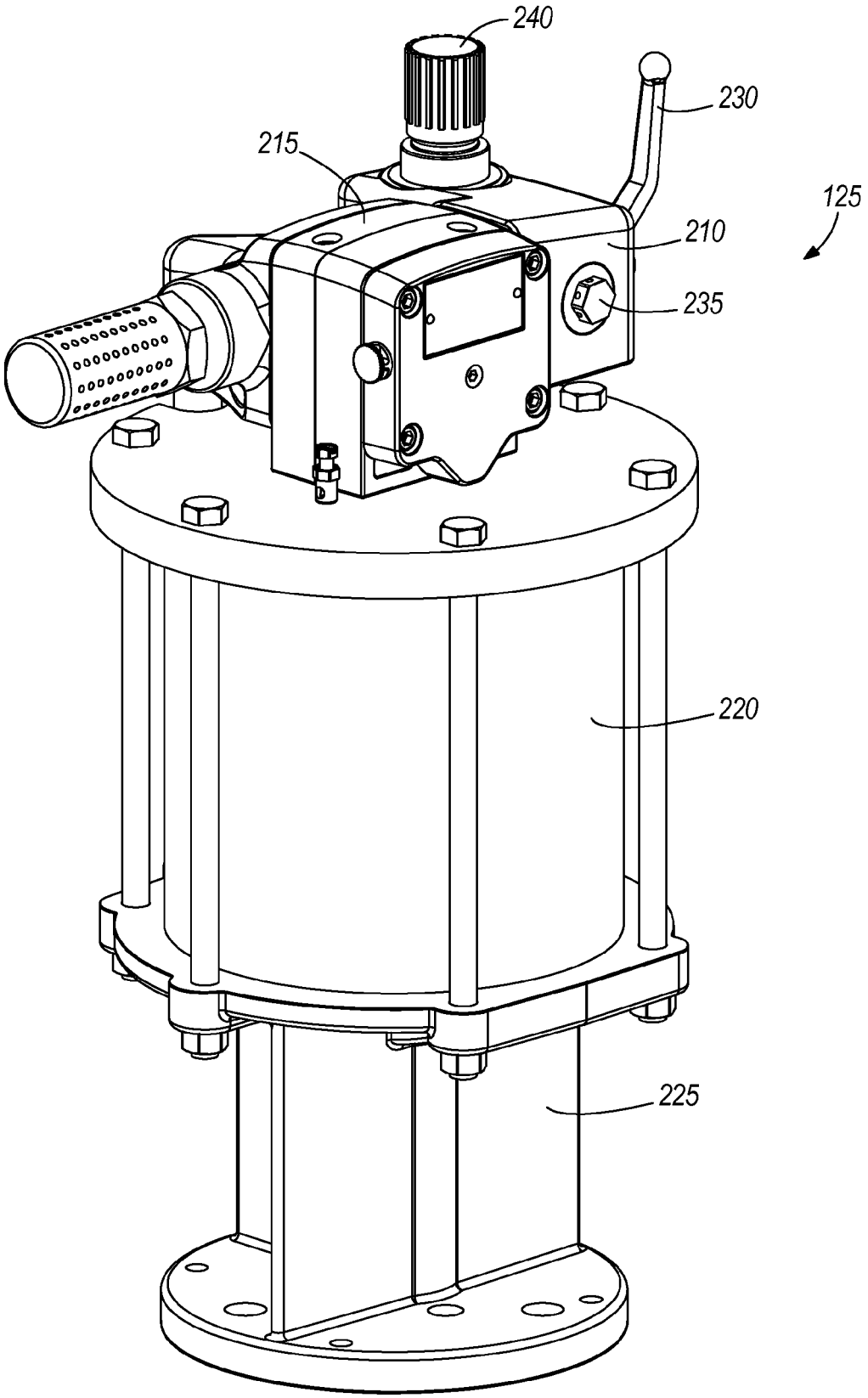
FIG. 3 is a reverse perspective view of the air motor of FIG. 2.

FIGS. 2 and 3 illustrate the air motor 125, which includes a pressure regulator assembly 210, a valve block assembly 215, a cylinder assembly 220, and a lower end assembly 225. The pressure regulator assembly 210 provides a connection point 227 for the motor hose 160 that supplies motive fluid to the air motor 125. The pressure regulator assembly 210 includes a handle 230 which has an on position, an off position, and a bleed position. In the on position, motive fluid is supplied to the air motor 125 and in the off position, motive fluid is not provide to the air motor 125. In the bleed position, operation of the air motor 125 is shut down and motive fluid is permitted to bleed out of the air motor 125 through a bleed valve 235. The pressure regulator 210 also includes a pressure adjustment handle 240, which can be rotated one way or the other to increase or decrease the pressure of motive fluid supplied to the air motor 125.

Figure 4:
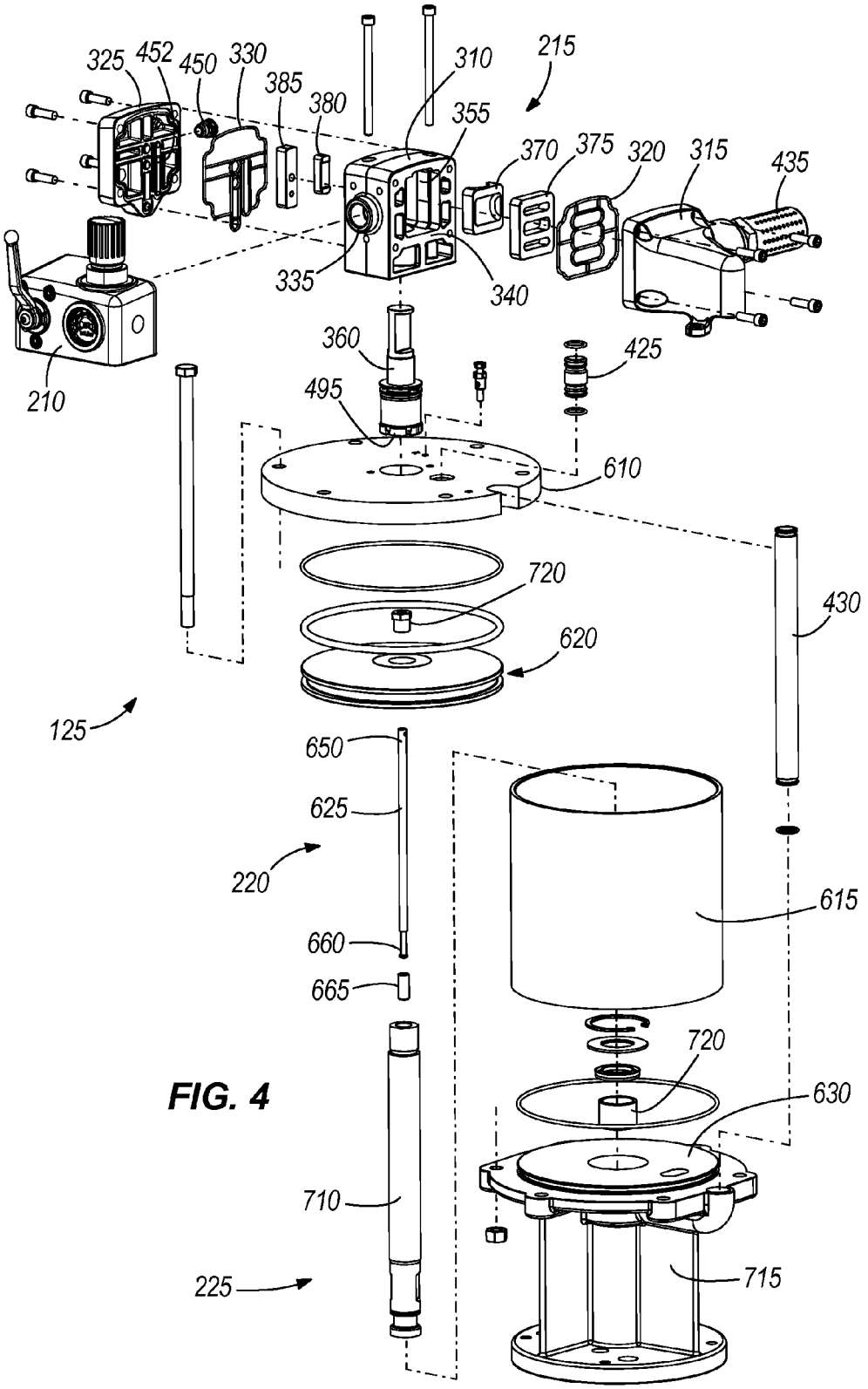
FIG. 4 is an exploded view of the air motor.
Figure 5:
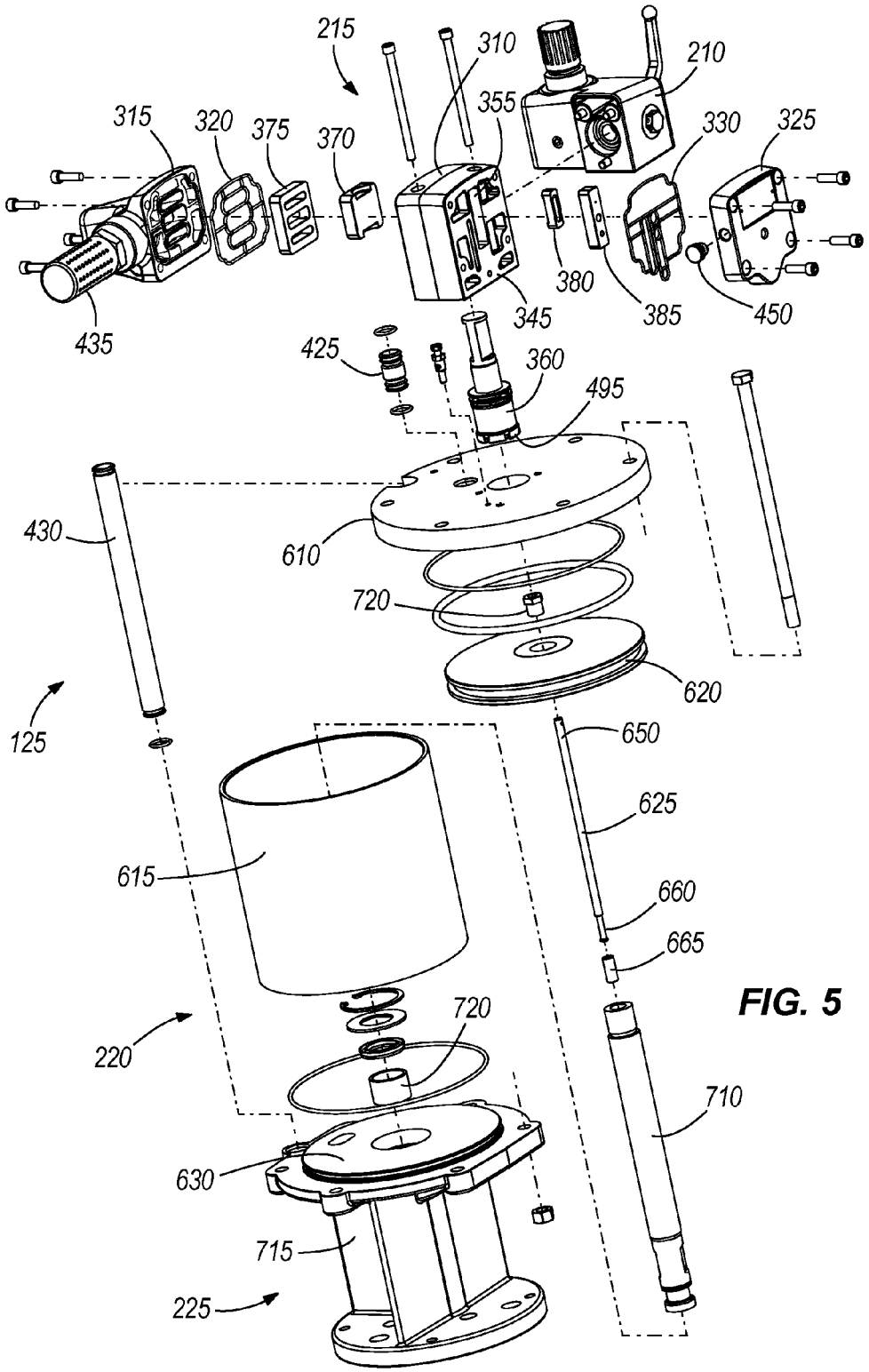
FIG. 5 is a reverse exploded view of the air motor.

With reference to FIGS. 4 and 5, the valve block assembly 215 includes a valve housing 310, a manifold cover 315, a manifold gasket 320, a pilot cover 325, and a pilot gasket 330. The valve housing 310 includes a motive fluid inlet 335, a manifold side 340, and a pilot side 345. The motive fluid inlet 335 communicates with the pressure regulator 210 to receive motive fluid for operation of the air motor 125. The manifold cover 315 and the manifold gasket 320 are mounted to the manifold side 340 of the valve housing 310, and the pilot cover 325 and the pilot gasket 330 are mounted to the pilot side 345 of the valve housing 310.

A valve chamber 355 is defined within the valve housing 310 between the manifold cover 315 and the pilot cover 325. Within the valve chamber 355 is a valve assembly, which includes a spool valve 360, a D-valve 370, a D-valve plate 375, a pilot valve 380, and a pilot valve plate 385. The spool valve 360 actually an assembly of parts, some of which will be described in more detail below. The spool valve 360 is generally centered within the valve chamber 355. The D-valve 370 and D-valve plate 375 are on the manifold side 340 of the valve housing 310, and the pilot valve 380 and pilot valve plate 385 are on the pilot side 345 of the valve housing 310.

Turning now to FIGS. 6-9, the manifold cover 315 defines an upper chamber port 410, a lower chamber port 415, and a manifold exhaust port 420. A short drop tube 425 is received within the upper chamber port 410, a long drop tube 430 is received within the lower chamber port 415, and a muffler 435 (FIGS. 4 and 5) is received within the manifold exhaust port 420. Each of the short drop tube 425, long drop tube 430, and muffler 435 may include an O-ring seal for creating an air-tight seal between the ports and the tubes or muffler received in the ports. The pilot cover 325 defines a two-way pilot conduit 440 and a pilot exhaust conduit 445. A vent plug 450 (FIGS. 4 and 5) is received within the pilot exhaust conduit 445. The pilot cover 325 further includes a dedicated exhaust conduit 452 that communicates with the pilot exhaust conduit 445.

The D-valve plate 375 includes a first D-valve port 455, a second D-valve port 460, and a D-valve exhaust port 465 between the first and second ports 455, 460. The first D-valve port 455, second D-valve port 460, and D-valve exhaust port 465 of the D-valve plate 375 register with the upper chamber port 410, lower chamber port 415, and the manifold exhaust port 420, respectively, in the manifold cover 315. The pilot valve plate 385 includes a first pilot port 470 and a second pilot port 475. The two-way pilot conduit 440 and pilot exhaust conduit 445 register with the first pilot port 470 and second pilot port 475, respectively.

The spool valve 360 includes an upper portion with a reduced-diameter section 480, a lower portion with an enlarged-diameter section 485, and a cup 487 in which the enlarged-diameter section 485 reciprocates. The enlarged-diameter section 485 includes a blind bore 490. A cover 495 secured across the opening of the blind bore 490 and held in place with a snap ring. A cup seal 510 on the outside of the enlarged-diameter section 485 creates a seal between the spool valve 360 and the valve housing 310. The portion of the valve chamber 355 below the cup seal 510 and outside of the cup 487 defines a pilot chamber 515 Immediately below the cup seal 510 is a vent bushing 517 which communicates between the inside of the cup 487 and the dedicated exhaust conduit 452. As a result, the inside of the cup 487 is constantly in communication with atmosphere through the vent bushing, dedicated exhaust conduit 452, and pilot exhaust conduit 445. This accommodates displaced and sucked in air above the head of the enlarged diameter section 485 during reciprocating movement of the spool valve 360. The two-way pilot conduit 440 communicates with the pilot chamber 515 below the vent bushing 517.

The D-valve 370 and pilot valve 380 are captured within a the reduced-diameter section 480 of the spool valve 360. As a result, the D-valve 370 and pilot valve 380 are coupled for reciprocation with the spool valve 360. The D-valve 370 includes a flat surface which abuts against and slides with respect to the D-valve plate 375. The D-valve 370 includes an arcuate, concave surface 520 that opens toward the D-valve plate 375. The flat surface of the D-valve surrounds the concave surface 520. The D-valve includes cut-outs 525 at the top and bottom which cause lost motion between the D-valve and the spool valve 360. The pilot valve 380 fits tightly within the reduced-diameter section 480 of the spool valve 360 so there is no lost motion. The pilot valve 380 includes an concave surface 530 that faces the pilot valve plate 385, and the pilot valve 380 includes a flat surface that surrounds the concave surface 530 and slides against the pilot valve plate 385.

Referring again to FIGS. 4 and 5, the cylinder assembly 220 includes a top plate 610, cylinder 615, a piston 620, an actuation rod 625, and a bottom plate 630. As shown in FIGS. 10-13, the space within the cylinder 615 between the top plate 610 and the piston 620 defines an upper chamber 635, and the space within the cylinder 615 between the bottom plate 630 and the piston 620 defines a lower chamber 640. The top plate 610 includes a top plate port 648 with which receives the lower end of the short drop tube 425. The top plate port 648 places the upper chamber port 410 and short drop tube 425 in fluid communication with the upper chamber 635. The actuation rod 625 includes a first end 650 to which a cap 655 (FIG. 6) is pinned and a second opposite end 660 to which a low friction sleeve 665 is attached.

With continued reference to FIGS. 4 and 5, the lower end assembly 225 includes an output shaft 710 and a base 715 on which the cylinder assembly 220 sits. The output shaft 710 is threaded into a central hole in the piston 620. The output shaft 710 also includes a lower end that extends into a through bore in the base 715. The lower end provides an attachment point for the piston pump assembly 120. The lower end assembly 225 also includes a bushing 720 in the base 715, to facilitate longitudinal reciprocation of the output shaft 710. As seen in FIGS. 10-13, the output shaft 710 includes a blind bore 725. A low-friction bushing 730 is fit within the upper end of the output shaft 710.

As illustrated in FIGS. 6-9, the first end 650 of the actuation rod 625 extends through the cover 495 in the enlarged-diameter section 485 of the spool valve 360, and is captured within the enlarged-diameter section 485 on account of the cap 655 being pinned to the first end 650. As illustrated in FIGS. 10-13, the second end 660 and sleeve 665 are received within the bore 725 of the output shaft 710, and are captured within the bore 725 by the low-friction bushing 730.

The base 715 includes a base port 810 into which the lower end of the long drop tube 430 is received. The base port 810 places the lower chamber port 415 and long drop tube 430 in fluid communication with the lower chamber 640.

Figure 6:
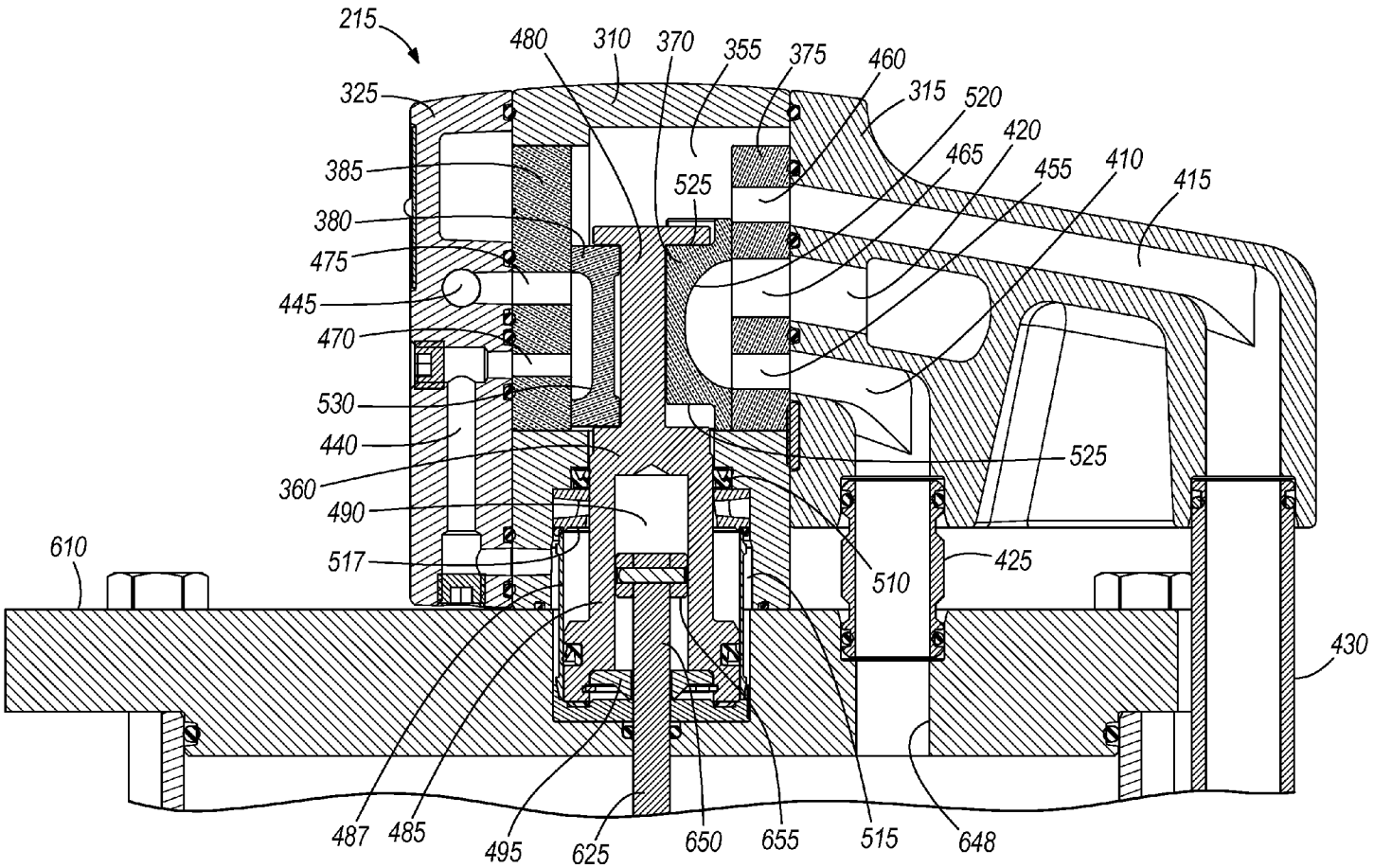
FIG. 6 is a cross-sectional view of the top end of the air motor, with the spool valve in a first position.

A cycle of operation of the valve assembly will now be described with reference to FIGS. 6-9. In FIG. 6, the spool valve 360 is in the fully-down position. The first end 650 of the actuation rod 625 is in between the top of the blind bore 490 and the cover 495 in the spool valve 360. The pilot valve 380 places the pilot chamber 515 in fluid communication with the pilot exhaust conduit 445, such that the pilot chamber 515 is at or near atmospheric pressure. The valve chamber 355 above the spool valve 360 is at the elevated pressure of the motive fluid.

The D-valve is pulled down by the spool valve 360. The upper chamber 635 is vented to atmosphere through the top plate port 648, the short drop tube 425, the upper chamber port 410, the first D-valve port 455, the concave surface 520 of the D-valve 370, the D-valve exhaust port 465, the manifold exhaust port 420, and the muffler 435. At the same time, the D-valve has uncovered the second D-valve port 460, such that motive fluid flows out of the valve chamber 355, through the second D-valve port 460, through the lower chamber port 415, through the long drop tube 430, through the base port 810, and into the lower chamber 640. As a result of this valve positioning, the piston 620 rises, which causes the actuation rod 625 to rise.

Figure 7:
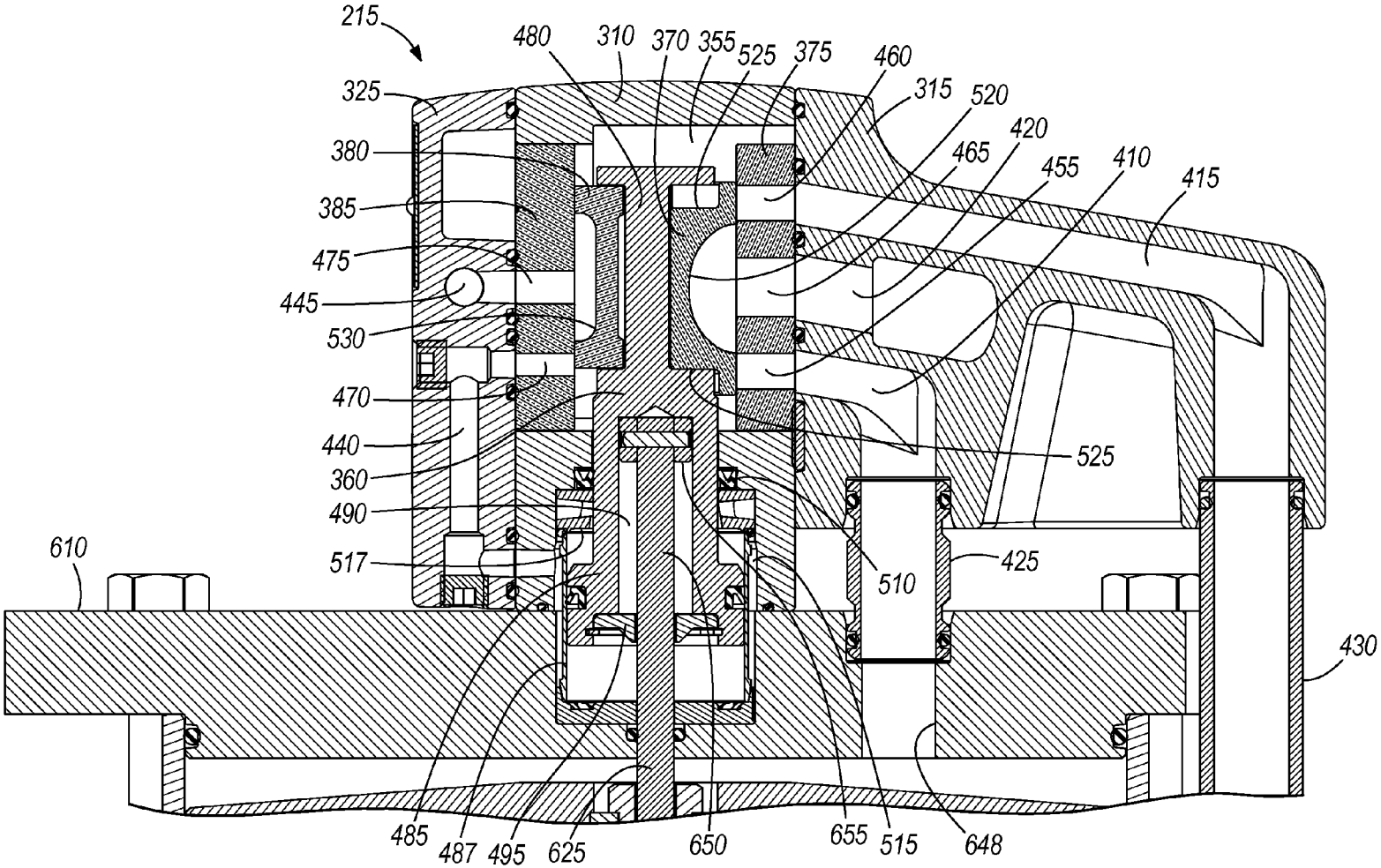
FIG. 7 is a cross-sectional view of the top end of the air motor, within the spool valve in a second position.

FIG. 7 illustrates the actuation rod 625 having risen sufficiently to overcome the lost motion associated with the top of the actuation rod 625 topping out within the blind bore 490 in the enlarged-diameter section 485 of the spool valve 360. The actuation rod 625 has also risen sufficiently to push the spool valve 360 up to a point at which the pilot valve 380 starts to uncover the first pilot port 470. Also, upward movement of the spool valve 360 has covered the lost motion associated with the D-valve 370, as the spool valve 360 has abutted the cutout surface 525 and started to move the D-valve 370 up. The flat surface of the D-valve 370 at this point covers both the first D-valve port 455 and the second D-valve port 460, so the valve chamber 355 is cut off from communication with both the upper and lower chambers 635, 640. Because the first pilot port 470 is partially uncovered by the pilot valve 380, motive fluid rushes to the pilot chamber 515 through the first pilot port 470 and the two-way pilot conduit 440. With the exception of the communication of the inside of the cup 487 with atmosphere through the vent bushing 517, the entire valve chamber 355 (both above the spool valve 360 and below the spool valve 360 in the pilot chamber 515) is at the pressure of the motive fluid.

Figure 8:
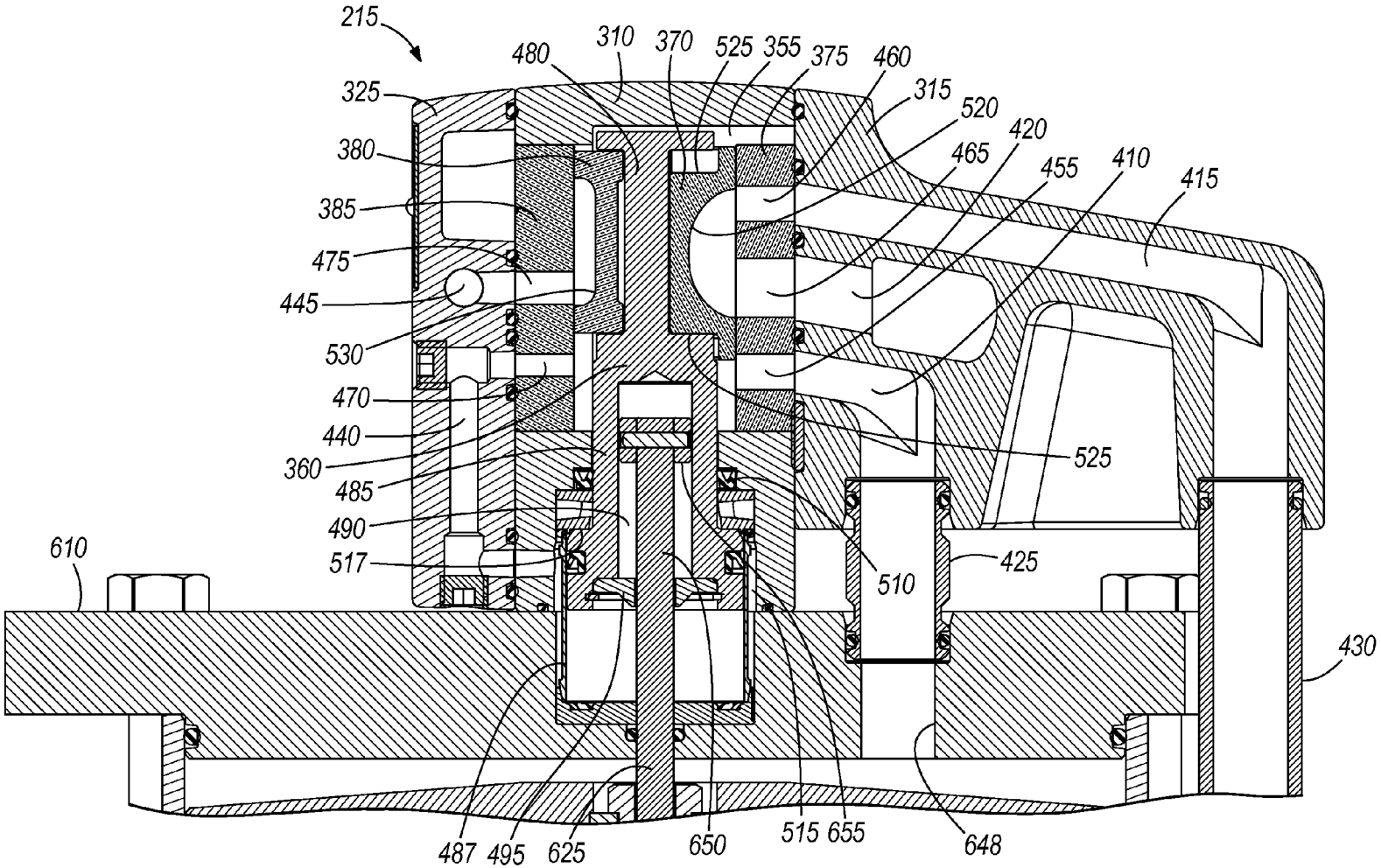
FIG. 8 is a cross-sectional view of the top end of the air motor, within the spool valve in a third position.

In FIG. 8, the spool valve 360 is topped out within the valve chamber 355. The top of the spool valve 360 has a smaller surface area than the bottom of the spool valve 360. Because the top and bottom are exposed to the same pressure, the resultant force on the bottom of the spool valve 360 is greater than the resultant force on the top of the spool valve 360. Consequently, the spool valve 360 moves up under the influence of the force difference, without the aid of the actuation rod 625. The first end 650 of the actuation rod 625 is in between the top of the blind bore 490 and the cover 495 in the spool valve 360.

The pilot valve covers the second pilot port 475 and pilot exhaust conduit 445. The lower chamber 640 is vented to atmosphere through the base port 810, the long drop tube 430, the lower chamber port 415, the second D-valve port 460, the concave surface 520 of the D-valve 370, the D-valve exhaust port 465, the manifold exhaust port 420, and the muffler 435. At the same time, the D-valve has uncovered the first D-valve port 455, such that motive fluid flows out of the valve chamber 355, through the first D-valve port 455, through the upper chamber port 410, through the short drop tube 425, through the top plate port 648, and into the upper chamber 635. As a result of this valve positioning, the piston 620 lowers, which causes the actuation rod 625 to lower.

Figure 9:
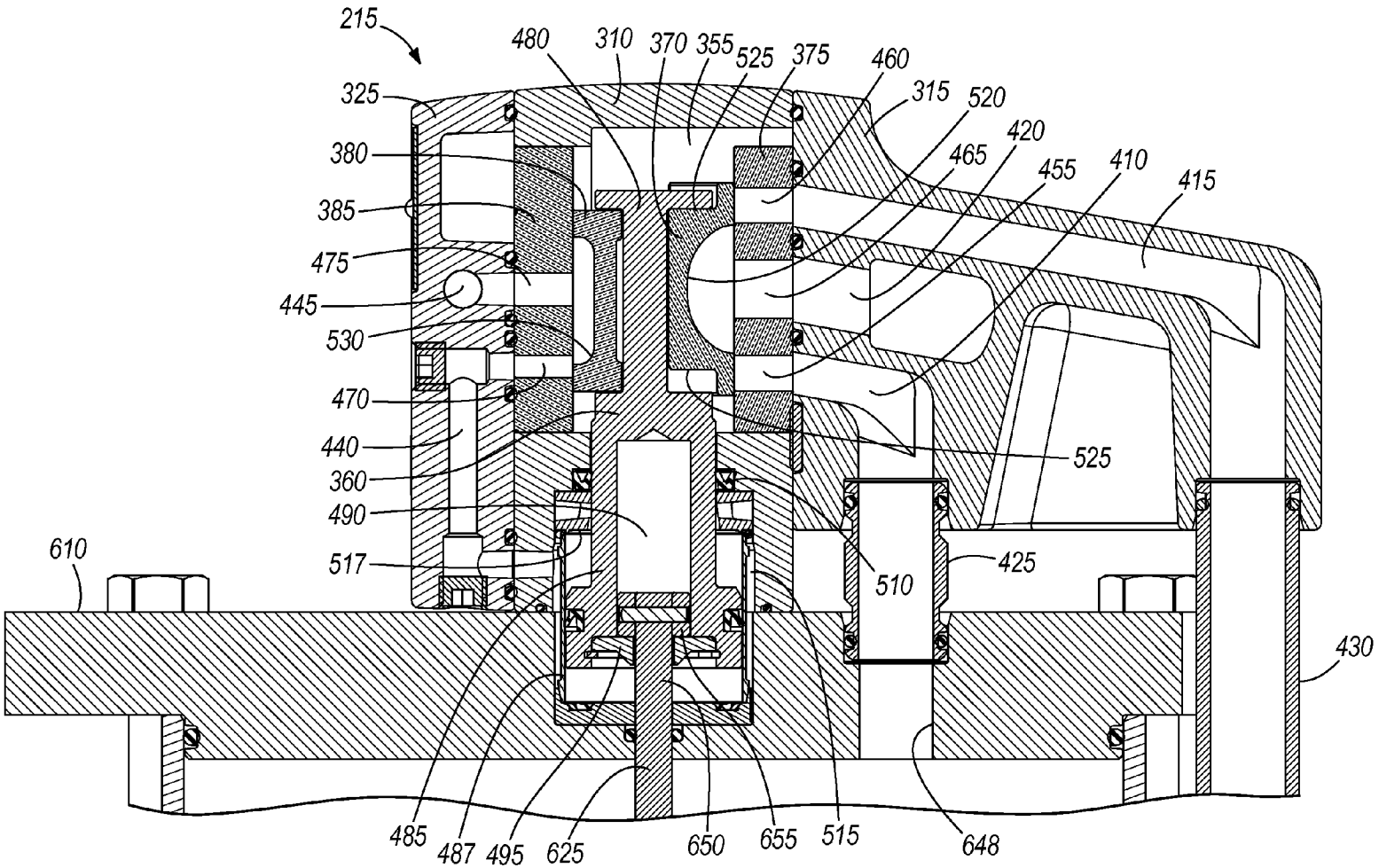
FIG. 9 is a cross-sectional view of the top end of the air motor, within the spool valve in a fourth position.

FIG. 9 illustrates a valve positioning in which the actuation rod 625 has overcome the lost motion portion of the spool valve 360 (i.e., the cap 655 has bottomed out on the cover 495), and the spool valve 360 has overcome the lost motion portion of the D-valve 370 (i.e., the top of the spool valve 360 has abutted the top cut-out 525 of the D-valve 370). The spool valve 360 has moved down sufficiently to place the first pilot port 470 in communication with the second pilot port 475 via the pilot valve 380. As a result, motive fluid flows out of the pilot chamber 515 through the two-way pilot conduit 440, the first pilot port 470, the pilot valve 380, the second pilot port 475, the pilot exhaust conduit 445, and the vent plug 450. The pilot chamber 515 is therefore at atmospheric pressure. The flat surface of the D-valve 370 at this point covers both the first D-valve port 455 and the second D-valve port 460, so the valve chamber 355 is cut off from communication with both the upper and lower chambers 635, 640.

The portion of the valve chamber 355 above the spool valve 360 is at motive fluid pressure, and the portion of the valve chamber 355 below the spool valve 360 (i.e., the pilot chamber 515) is at atmospheric pressure. As a result, the spool valve 360 is pushed down from the position in FIG. 9 to the position in FIG. 6. The D-valve 370 is moved down by the spool valve 360, which places the lower chamber 640 in communication with motive fluid and places the upper chamber 635 in communication with atmosphere, as discussed above. At this point, a cycle of operation is complete.

Figure 10:
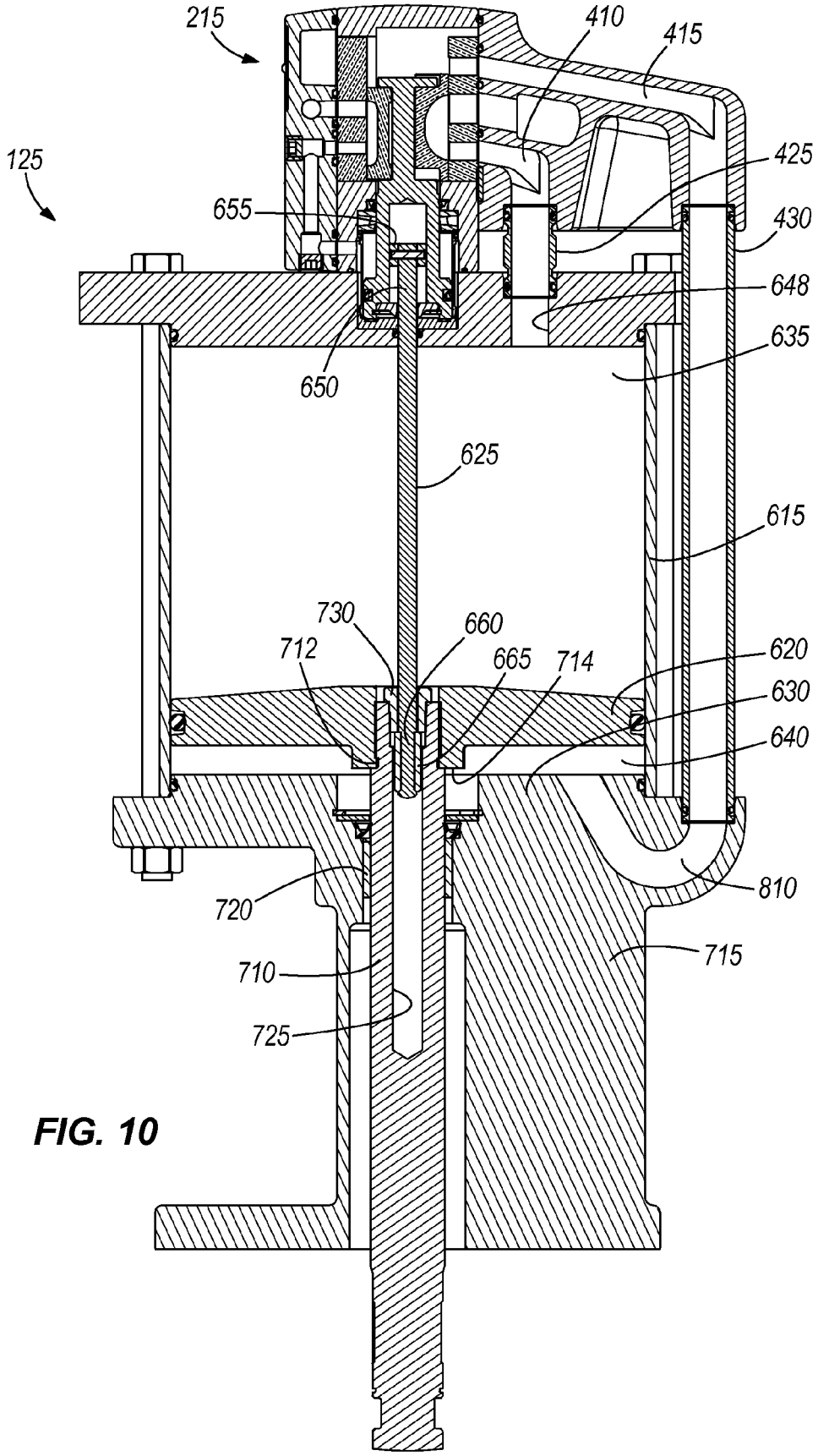
FIG. 10 is a cross-sectional view of the air motor in a first position in the operational cycle.

FIGS. 10-15 illustrate a full cycle of operation of the cylinder assembly 220 and lower end assembly 225 of the air motor 125. In FIG. 10, the piston 620 is in the fully down position, with the spool valve 360 having just shifted to its fully-down position (i.e., the position illustrated and described above with respect to FIG. 6). The sleeve 665 on the second end 660 of the actuation rod 625 is topped out within the bore 725 of the output shaft 710, against the bushing 730. Motive fluid floods into the lower chamber 640 owing to the valve positioning described above with respect to FIG. 6, and the piston starts to rise.

Figure 11:
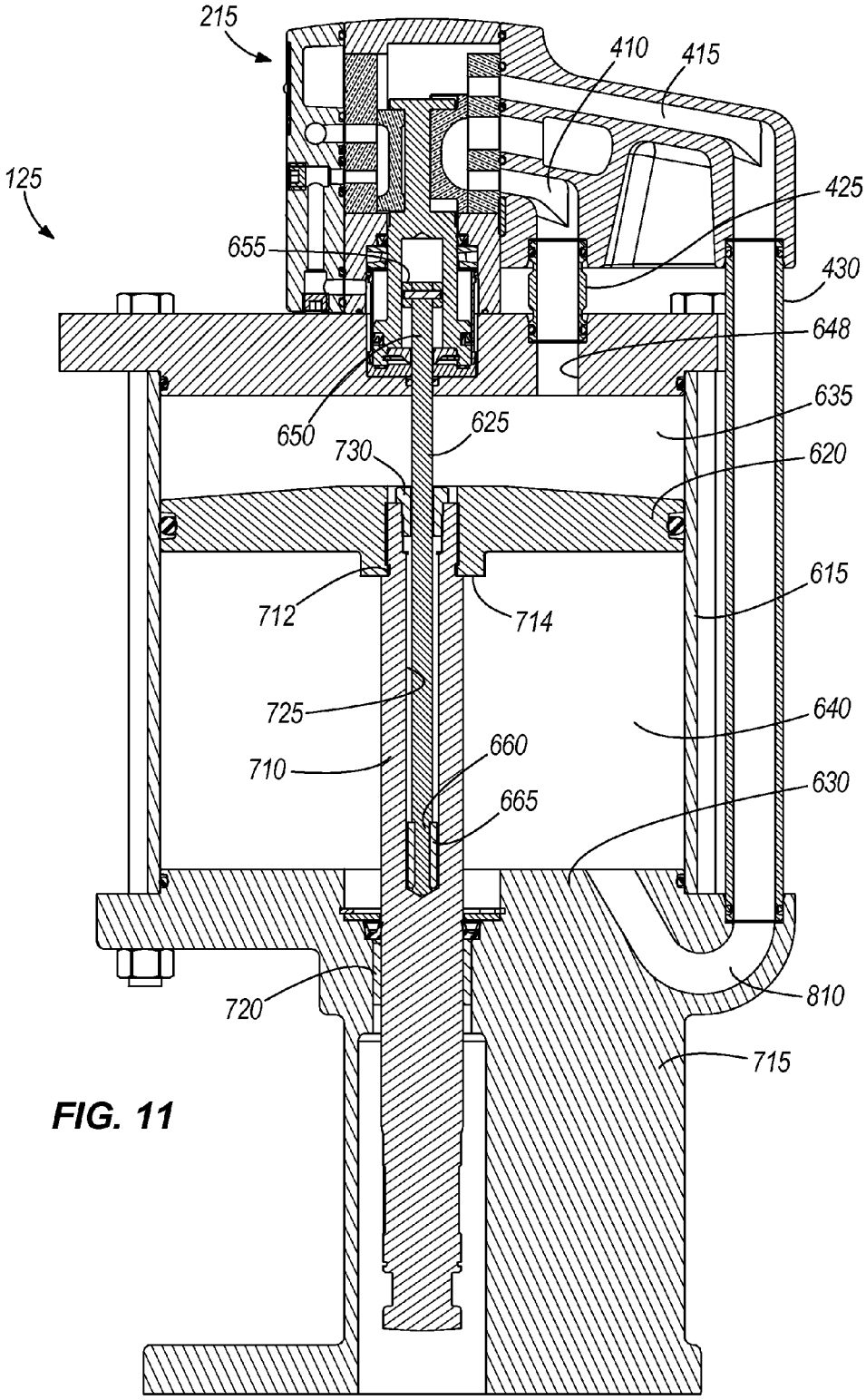
FIG. 11 is a cross-sectional view of the air motor in a second position in the operational cycle.

In FIG. 11, the piston has risen sufficiently so that the second end 660 of the actuation rod 625 bottoms out in the bore 725 of the output shaft 710, and the continued upward movement of the piston 620 pushes the actuation rod 625 up. There is therefore lost motion between the piston 620 and output shaft 710 on the one hand, and the actuation rod 625 on the other hand during the portion of upward piston movement between FIGS. 10 and 11.

Figure 12:
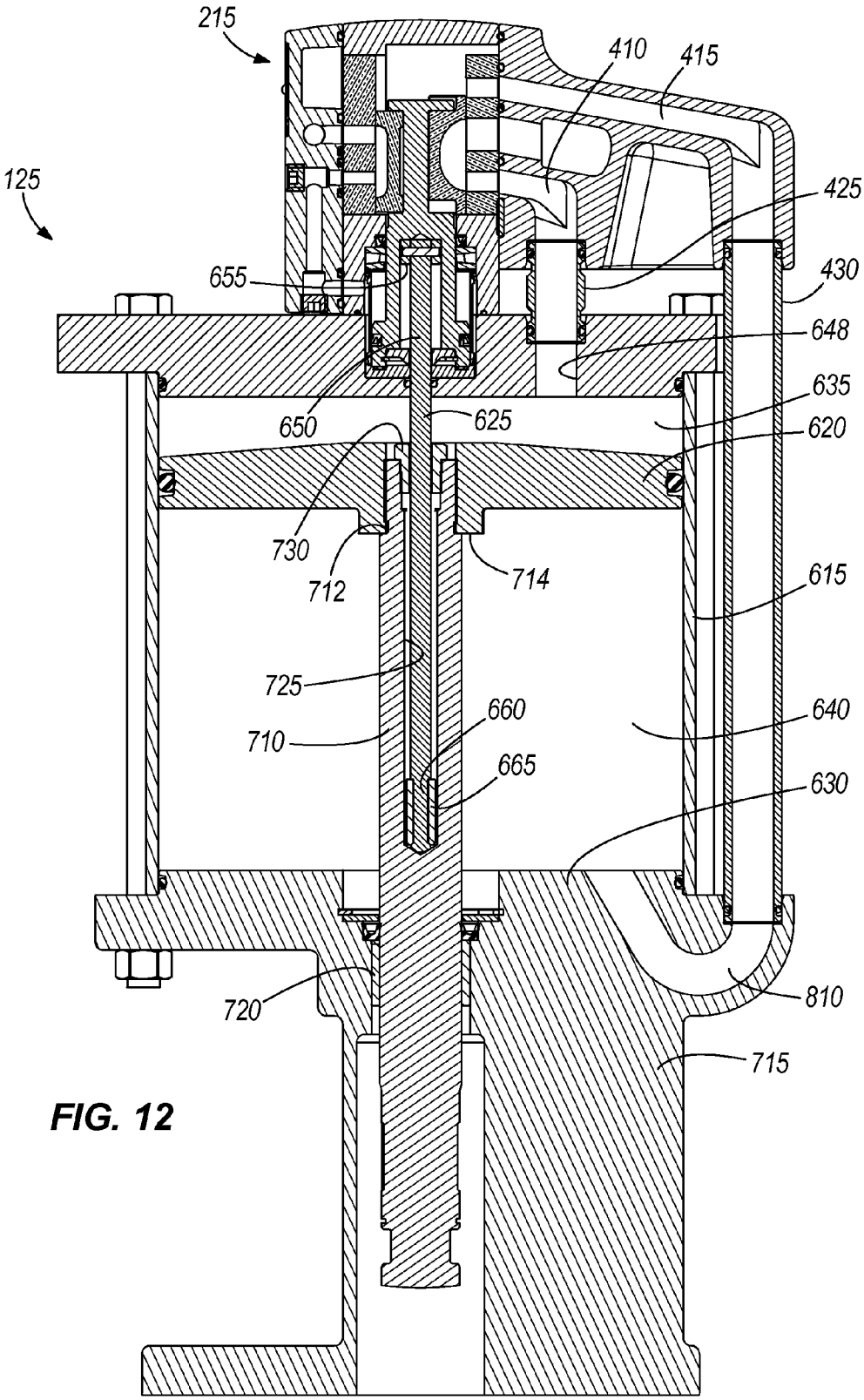
FIG. 12 is a cross-sectional view of the air motor in a third position in the operational cycle.

In FIG. 12, the piston has risen sufficiently to move the first end 650 of the actuation rod 625 into the topped out position with respect to the bore 490 in the spool valve 360, as discussed above with respect to FIG. 7. There is therefore further lost motion between the piston 620 and actuation rod 625 on the one hand, and the spool valve 360 on the other hand during the portion of upward piston movement between FIGS. 11 and 12.

Figure 13:
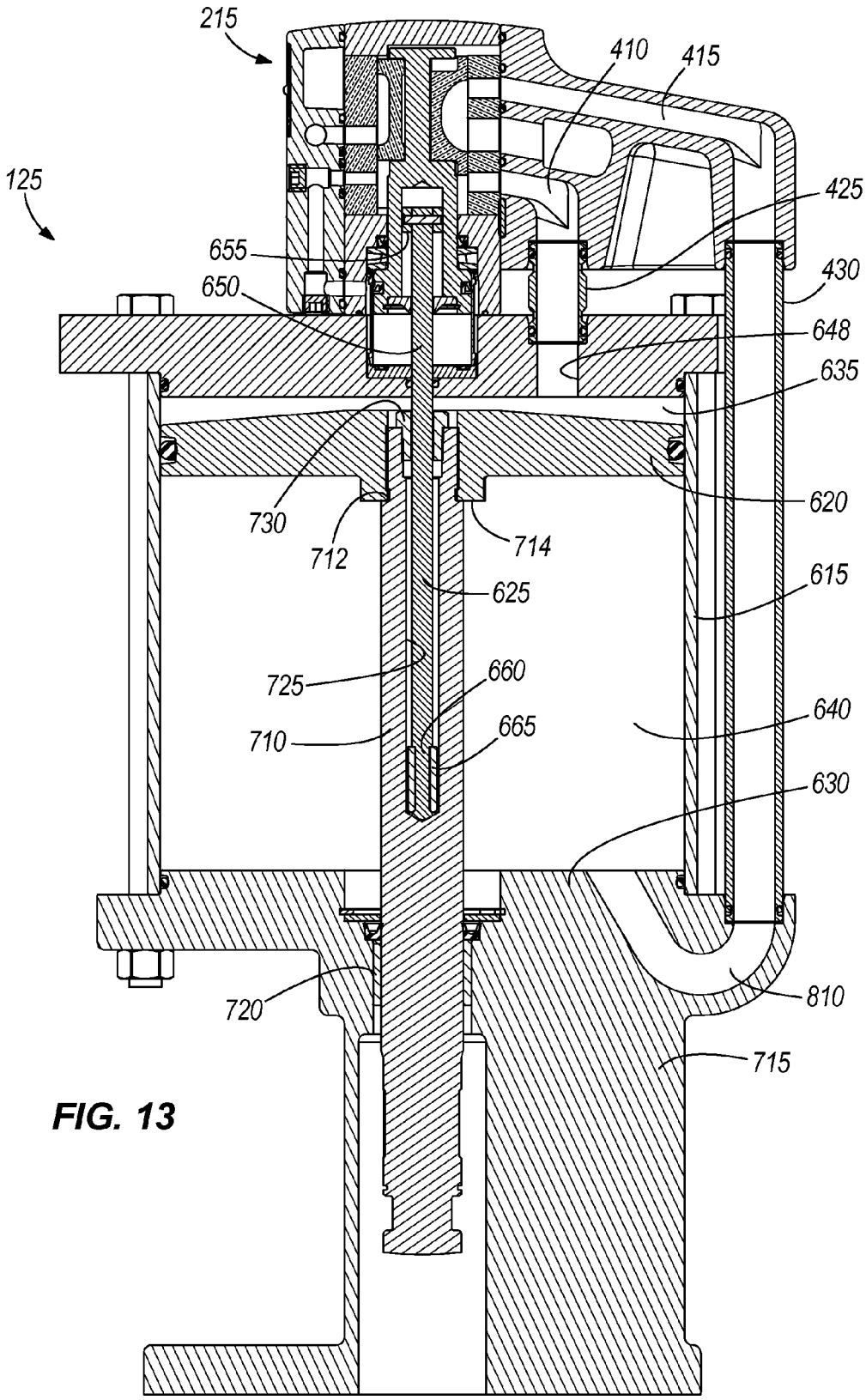
FIG. 13 is a cross-sectional view of the air motor in a fourth position in the operational cycle.

In FIG. 13, the spool valve 360 is in the full-up position as illustrated and described in FIG. 8. The top 650 of the actuation rod 625 is in between the top and bottom of the bore 490 in the spool valve 360.

Figure 14:
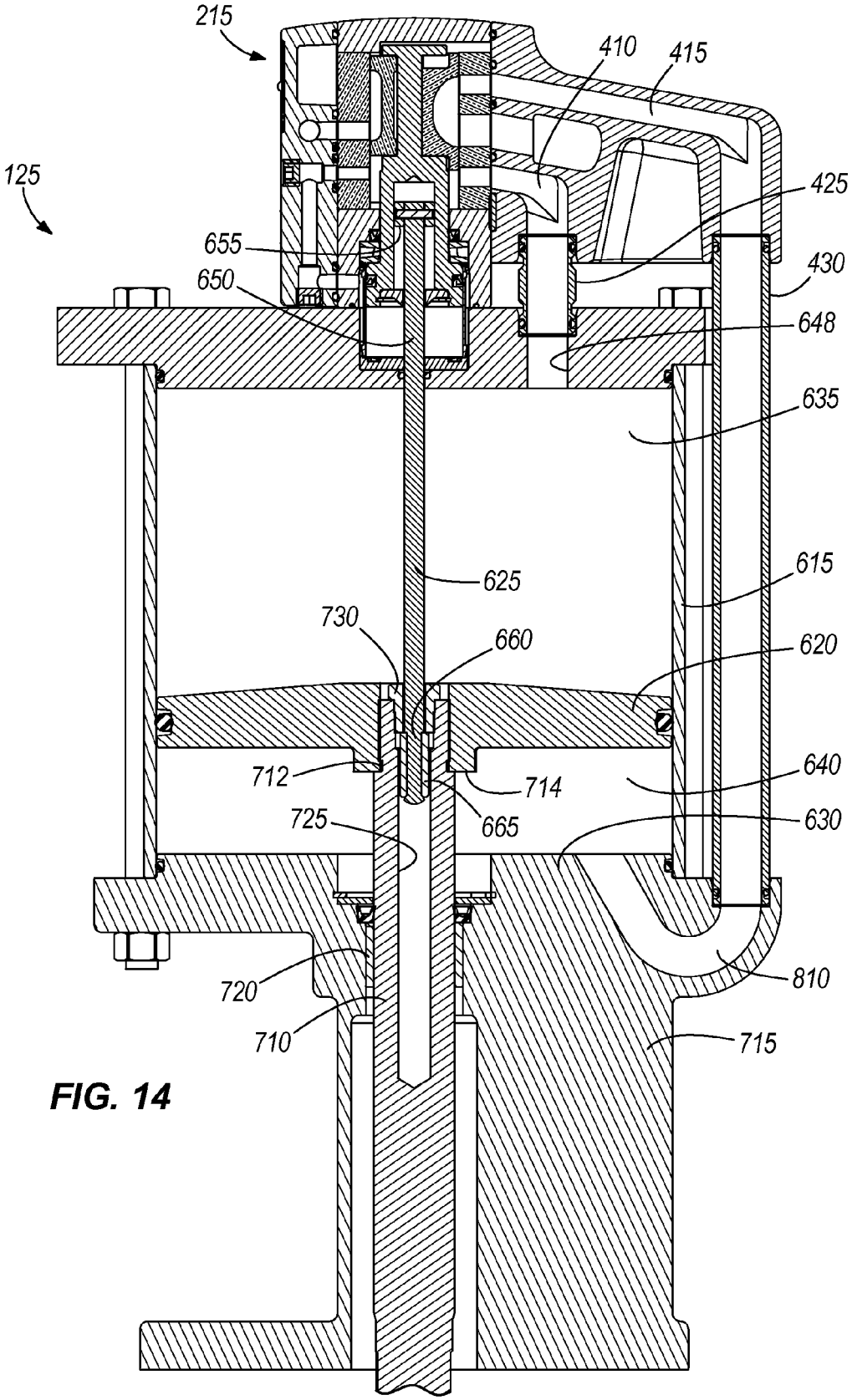
FIG. 14 is a cross-sectional view of the air motor in a fifth position in the operational cycle.

In FIG. 14, the valves 370, 380 are in the positions illustrated in FIG. 8, such that the piston 620 has started moving down. At the point illustrated in FIG. 14, the second end 660 of the actuation rod 625 has just topped out in the bore 725 of the output shaft 710, against the bushing 730. Further downward movement of the piston 620 from this position will pull the actuation rod 625 down with the piston and output shaft 710. There is therefore further lost motion between the piston 620 and output shaft 710 on the one hand, and the actuation rod 625 on the other hand between FIGS. 13 and 14.

Figure 15:
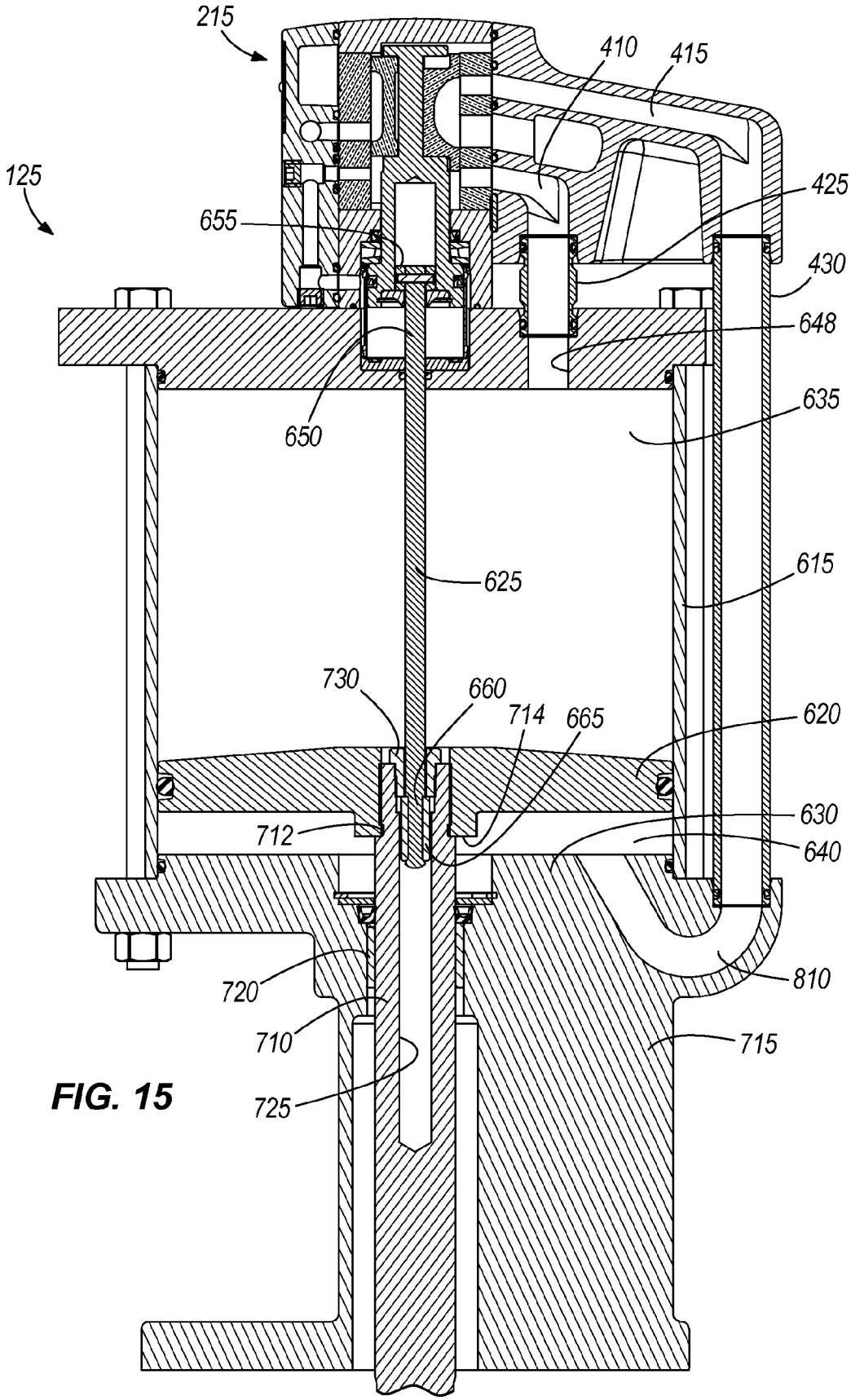
FIG. 15 is a cross-sectional view of the air motor in a sixth position in the operational cycle.

In FIG. 15, the first end 650 of the actuation rod 625 has just bottomed out in the bore 490 of the spool valve 360, with the cap 655 coming into contact with the cover 495. Further downward movement of the piston 620 from this position will pull the spool valve 360 down. There is therefore further lost motion between the piston 620 and actuation rod 625 on the one hand, and the spool valve 360 on the other hand between FIGS. 14 and 15. As the piston moves down from the position shown in FIG. 15, the spool valve reaches the positions shown in FIG. 9 and then FIG. 6, which results in motive fluid being routed to the lower chamber 640 while the upper chamber 635 is vented to exhaust through the muffler 435. Once this happens, the piston 620, actuation rod 625, and spool valve 360 are in the position illustrated in FIG. 10, and the cycle is complete.

Figure 16:
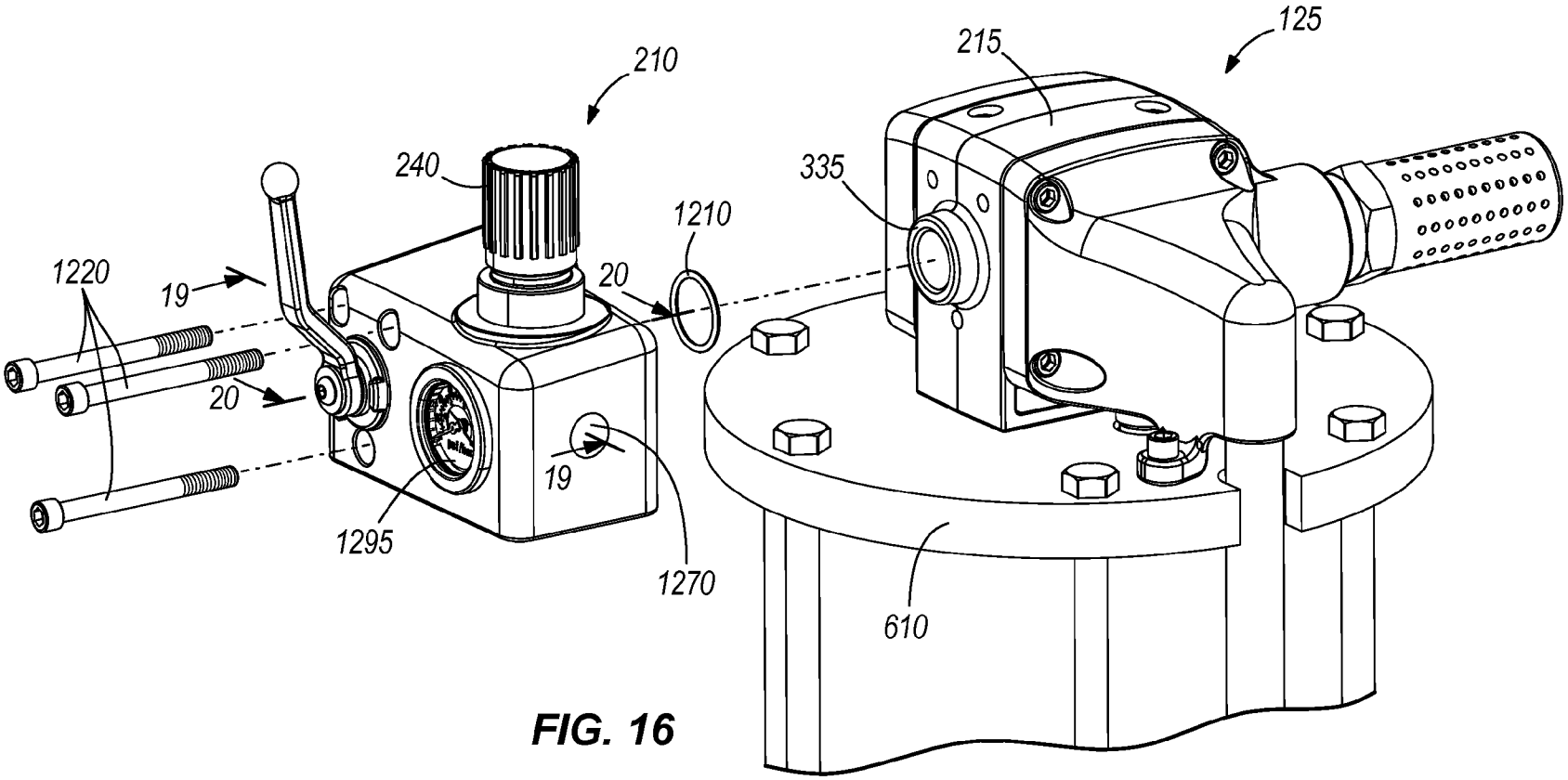
FIG. 16 is an exploded view of the top portion of the air motor, with the pressure regulator assembly separated from the valve block assembly.

FIG. 16 illustrates the pressure regulator assembly 210 exploded off of the valve block assembly 215 of the air motor 125. An O-ring 1210 is positioned between a pressure regulator outlet 1215 (FIG. 17) of the pressure regulator assembly 210 and the motive fluid inlet 335. The pressure regulator assembly 210 is removably coupled to the valve block assembly 215 by a plurality of fasteners 1220. The illustrated pressure regulator assembly 210 is a self-relieving ball valve type regulator and shut off. The valve is actuable by a user without the use of tools. The valve is a three-way, three-position valve.

Figure 17:
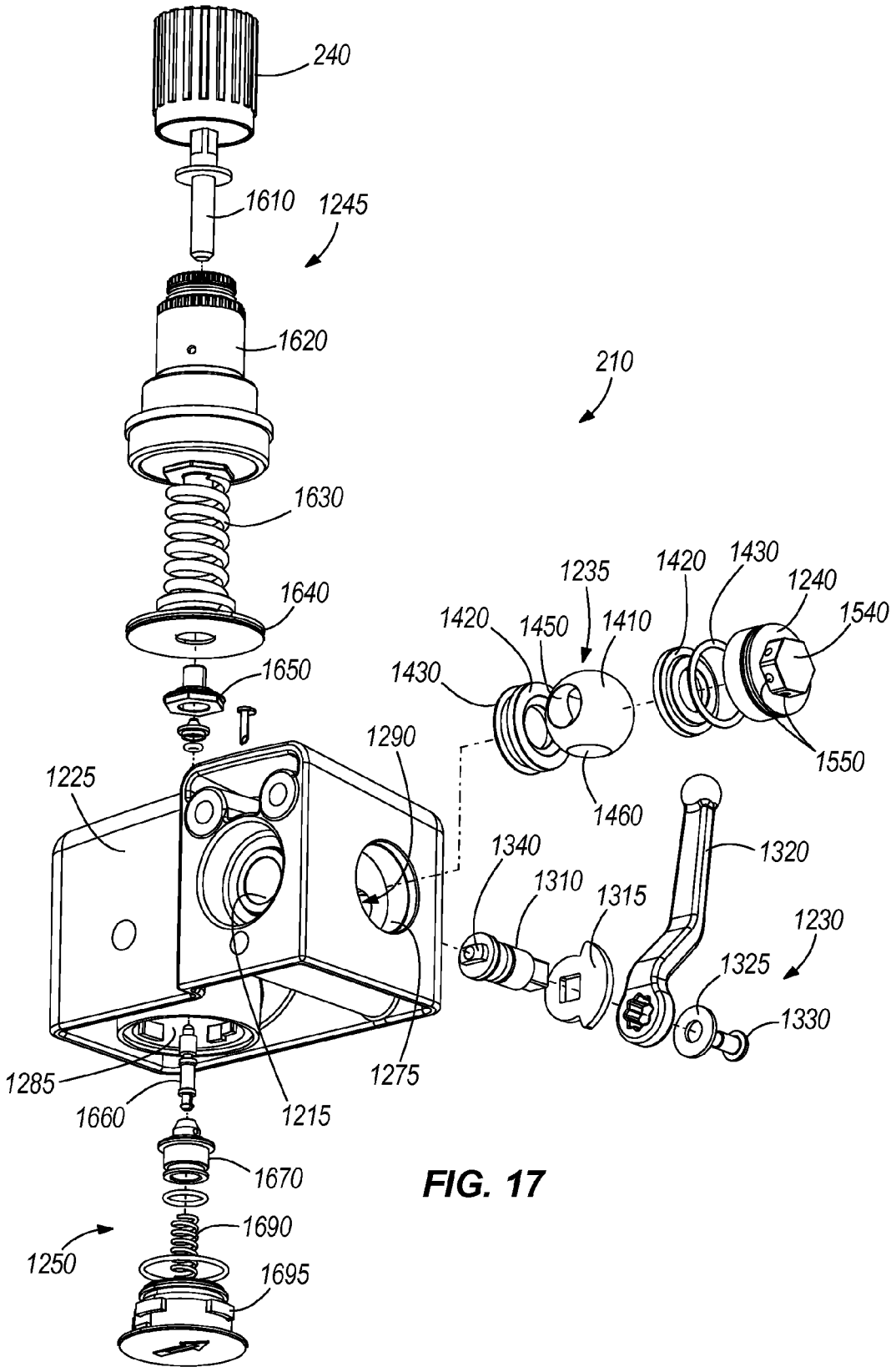
FIG. 17 is an exploded view of the pressure regulator assembly.

FIG. 17 illustrates the major components of the pressure regulator assembly 210, which include a housing 1225, an actuator assembly 1230, a ball valve assembly 1235, a bleed valve 1240, a first pressure adjustment assembly 1245, and a second adjustment assembly 1250. The housing 1225 includes a motive fluid input port 1270 (FIG. 16), the above-mentioned pressure regulator outlet 1215, a bleed valve port 1275, an actuator support 1280 (FIG. 20), a pressure adjustment chamber 1285, and a ball valve chamber 1290. The pressure regulator assembly 210 includes at least one gauge that displays at least one measurement parameter, such as pressure, temperature, volumetric flow rate, etc. The illustrated pressure regulator assembly 210 includes a pressure indicator 1295 (FIG. 16) provided in the housing 1225 so the operator can determine the pressure of motive fluid being supplied to the air motor 125.

Figure 18:
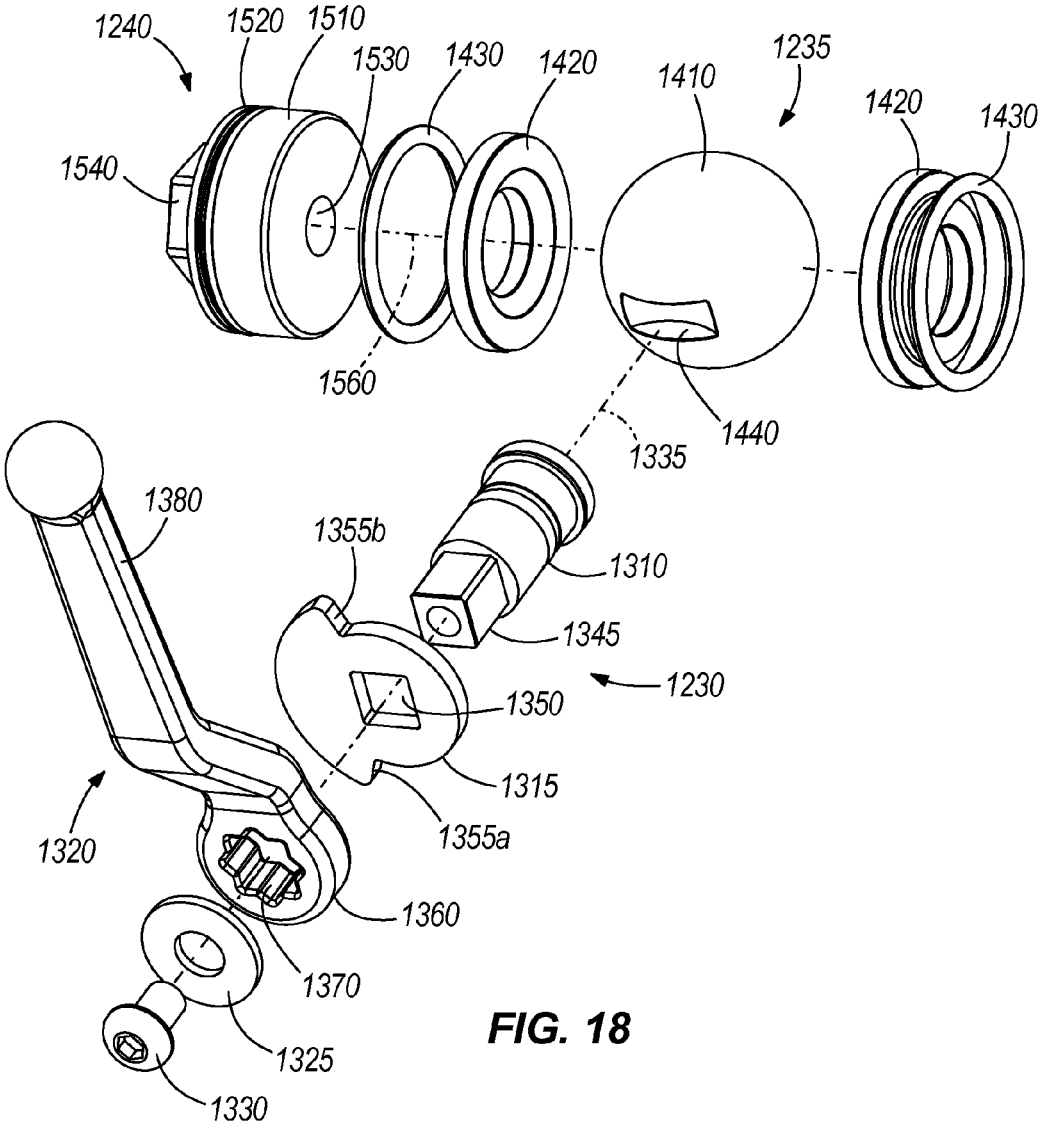
FIG. 18 is an exploded view of components of the pressure regulator assembly.

With additional reference to FIG. 18, the actuator assembly 1230 includes an actuator insert 1310, a hard stop 1315, a lever 1320, a washer 1325, and an actuator fastener 1330. The actuator insert 1310 is elongated and generally cylindrical, with a longitudinal axis 1335. The actuator insert 1310 includes a protrusion or key 1340 (FIG. 17) at one end and a square drive 1345 at an opposite end. The hard stop 1315 includes a square window 1350 and first and second stop shoulders 1355*a*, 1355*b*. The lever 1320 includes a hub 1360 having an internally toothed aperture 1370, and a handle 1380 extending away from the hub 1360 generally in a plane parallel to the hub 1360.

With continued reference to FIGS. 17 and 18, the ball valve assembly 1235 includes a ball 1410, a pair of seats 1420 made of brass or another wear resistant material, and a pair of seals 1430. The ball 1410 includes a slot or keyway 1440 that receives the protrusion or key 1340 of the actuator insert 1310. As seen in FIG. 17, the ball 1410 also includes a first aperture 1450 and a second aperture 1460 which communicate with each other and through sides of the ball 1410. The first and second apertures 1450, 1460 define an elbow or 90° conduit within the ball 1410.

The bleed valve 1240 includes a cylindrical portion 1510, a threaded portion 1520, a central bore 1530, and a hex head 1540 with vent ports 1550 (FIG. 17) that communicate with the central bore 1530 and through the flats on the hex head 1540. The central bore 1530 defines a central axis 1560. The hex head 1540 is engageable with a tool, such as a standard wrench, to install and remove the bleed valve 1240 from the bleed valve port 1275.

As assembled and installed, the actuator insert 1310 is received within the actuator support 1280 (FIG. 20) and supported there for rotation about the longitudinal axis 1335. The square window 1350 of the hard stop 1315 and the internally toothed aperture 1370 of the lever 1320 fit around the square drive 1345 of the actuator insert 1310, such that the lever 1320, hard stop 1315, and actuator insert 1310 are coupled for rotation together. The washer 1325 sits against an outwardly facing surface of the hub 1360 of the lever 1320, and the fastener 1330 threads into a threaded hole in the square drive 1345 end of the actuator insert 1310. The fastener 1330 and washer 1325 hold the lever 1320 on the actuator insert 1310.

The ball 1410 is received within the ball valve chamber 1290, with the key 1340 of the actuator insert 1310 received in the keyway 1440, such that the ball 1410 is coupled for rotation about the axis 1335 with the actuator assembly 1230. The seats 1420 and seals 1430 sit on opposite sides of the ball 1410 with the seats 1420 against the ball 1410. One of the seals 1430 sits against a wall of the ball valve chamber 1290. The other seal 1430 sits against the flat end of the cylindrical portion 1510 of the bleed valve 1240. The threaded portion

1520 of the bleed valve 1240 is threaded into the bleed valve port 1275. The seats 1420 and seals are ring-shaped and aligned along axis 1560, which is perpendicular to axis 1335. The seats 1420 support the ball for rotation about the axis 1335.

The first pressure adjustment assembly 1245 includes the pressure adjustment handle 240 described above, a push rod 1610, a main body 1620, a spring 1630, a washer 1640, and a seat 1650. The second adjustment assembly 1250 includes a needle 1660, a valve 1670, a spring 1690, and an end cap 1695. The main body 1620 and control handle 240 are mounted in an opening in the top of the housing 1225, and end cap 1695 is secured in an opening in the bottom of the housing 1225. The spring 1630 is between the top of the main body and the washer 1640. Upon rotation of the control handle 240, the control handle pushes the push rod 1610 down against the force of the spring 1630. On the lower side, the needle 1660 sits on top of the valve 1670. The spring 1690 is compressed between the valve 1670 and the end cap 1695, and biases the valve 1670 against a seat or rim 1710 in the housing 1225 to resist fluid flow past the valve 1670 and into the ball valve chamber 1290. Downward movement of the push rod 1610, under the influence of rotation of the control handle 240, eventually causes the push rod 1610 to push down on the needle 1660, which in turn causes the valve 1670 to unseat from the rim 1710 and open communication between the motive fluid inlet port 1270 and the ball valve chamber 1290. The degree to which the valve 1670 is unseated from the rim 1710 determines the pressure of motive fluid supplied to the ball valve chamber 1290 and ultimately to the rest of the air motor.

Figure 19:
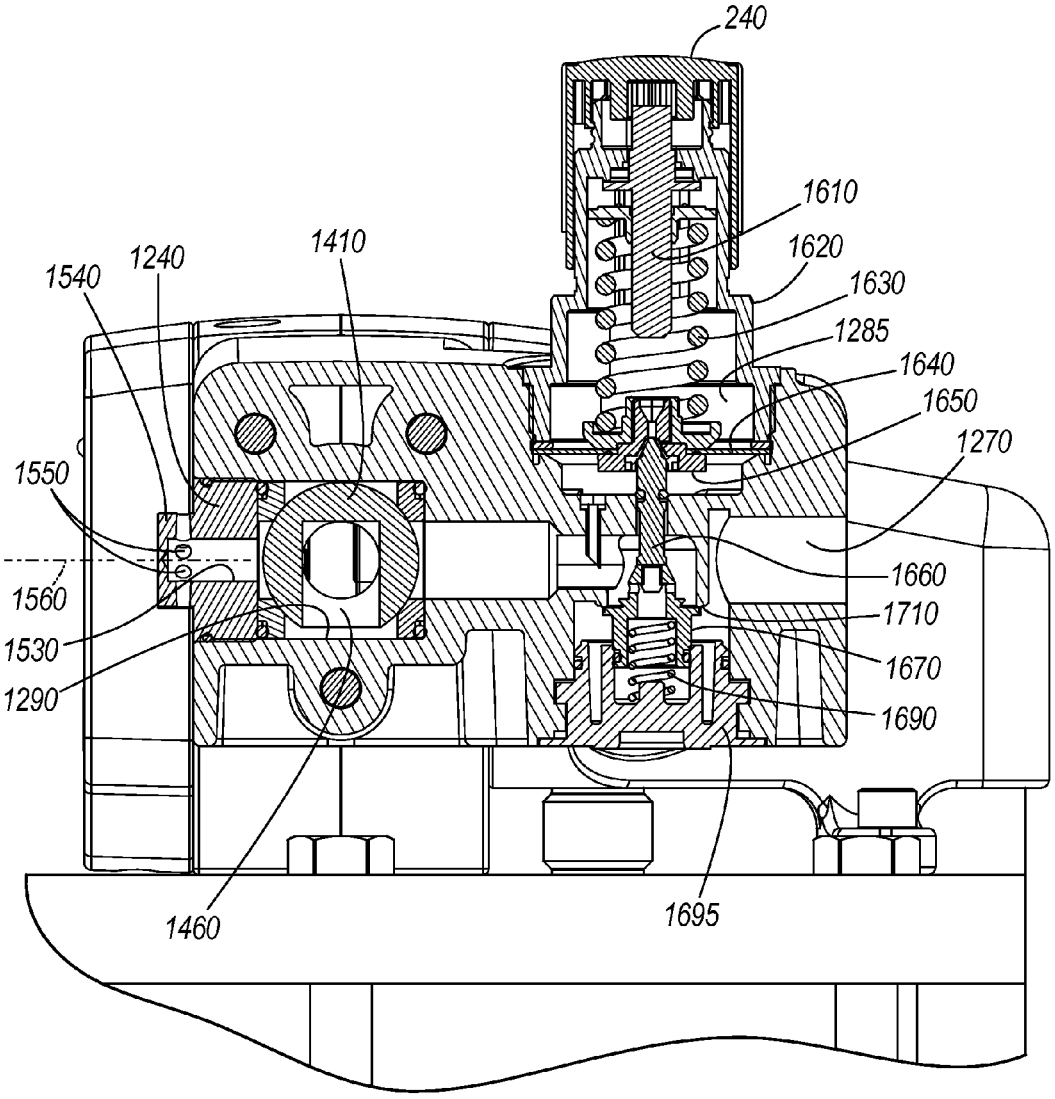
FIG. 19 is a cross-sectional view of the valve shut off taken along line 19-19 of FIG. 16.
Figure 20:
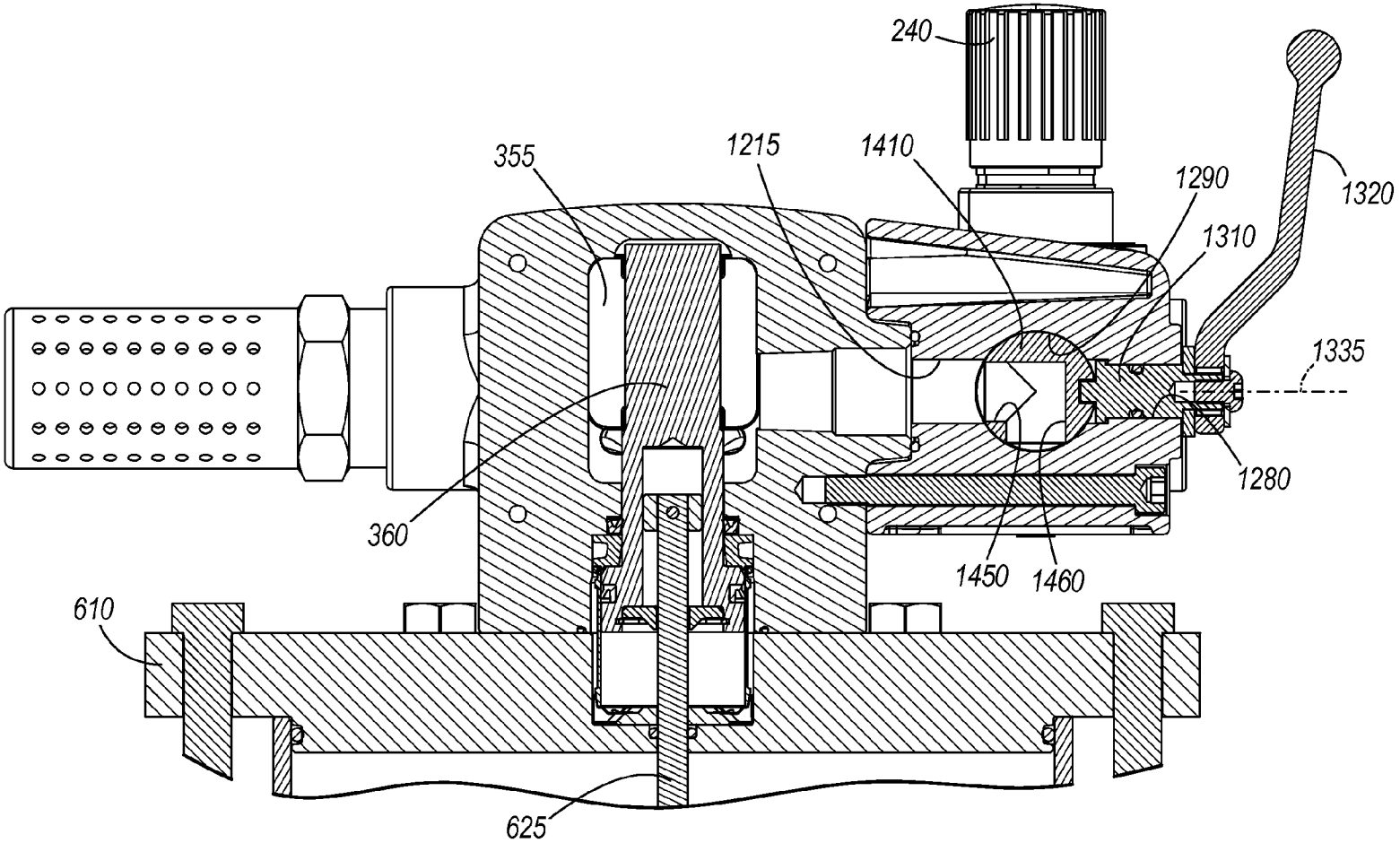
FIG. 20 is a cross-sectional view of the valve shut off taken along line 20-20 of FIG. 16.

In operation, the ball 1410 is rotated about the axis 1335, under the influence of an operator pivoting the lever 1320, between an off position, an on position, and a bleed position. In all positions, the first aperture 1450 in the ball 1410 is aligned with and communicates with the pressure regulator outlet 1215 along axis 1335. As seen in FIGS. 19 and 20, positioning the ball 1410 in the off position faces the second aperture 1460 downwardly in the ball valve chamber 1290, which results in motive fluid from the motive fluid inlet 1270 being stopped before entering the ball valve chamber 1290. In this position, the second aperture 1460 opens in a direction perpendicular to both the axis 1335 and the axis 1560.

When the ball 1410 is rotated about axis 1335 to the on position, the first stop shoulder 1335*a* comes into contact with a stop on the housing 1225. In this position, the second aperture 1460 is aligned with the motive fluid inlet 1270, such that motive fluid is routed through the ball 1410 and into the air motor valve block assembly 215. The second aperture opens along axis 1560 in this position, toward the motive fluid inlet 1270.

When the ball 1410 is rotated to the bleed position, the second stop shoulder 1335*b* comes into contact with another stop or the same stop on the housing 1225. In this position, the second aperture 1460 is aligned with the bleed valve port 1275. In this position, motive fluid in the air motor 125 can flow out through the pressure regulator outlet 1215, the ball 1410, the bleed valve port 1275, the bore 1530 in the bleed valve 1240, and the vent ports 1550. The second aperture opens along axis 1560 in this position, toward the bleed valve port 1275. The bleed valve 1240 permits a user to manually de-pressurize the air motor 125 without requiring the user to disconnect the motor hose 160 from the air motor 125.

It is advantageous to combine the actuator assembly 1230, the ball valve assembly 1235, the bleed valve 1240, the first pressure adjustment assembly 1245, and the second adjustment assembly 1250 into a single housing 1225 to form a module, such as in the illustrated pressure regulator assembly 210. The modular pressure regulator assembly 210 can be bolted on to the air motor 125 as a single modular component, and can be removed from the air motor 125 as a single component. In embodiments that do not bolt the pressure regulator assembly 210 to the air motor 125, a pipe or conduit is connected directly to the motive fluid inlet 335. Such embodiments utilize a remote pressure regulator to regulate pressure and thus, throttle of the air motor 125. The pressure regulator assembly 210 is configured to be coupled directly to the motive fluid inlet 335, without requiring the use of a separate pipe or a quick coupler.

Thus, the invention provides, among other things, a modular regulator for an air motor. Various features and advantages of the invention are set forth in the following claims.

What is claimed is:

1. An air motor comprising:

a motive fluid inlet (335) adapted to receive a flow of motive fluid;

a cylinder (615);

a piston (620) within the cylinder (615), the piston (620) dividing the cylinder (615) into an upper chamber (635) above the piston (620) and a lower chamber (640) below the piston (620);

a valve chamber (355) including a pilot chamber portion (515);

a spool valve (360) shiftable between first and second positions, the spool valve (360) including a reduced diameter section (480) and an enlarged diameter section (485), the enlarged diameter section (485) being exposed to the pilot chamber portion (515);

a D-valve plate (375) including a first D-valve port (455) communicating with the upper chamber (635), a second D-valve port (460) communicating with the lower chamber (640), and a D-valve exhaust port (465) communicating with atmosphere;

a D-valve (370) having a flat surface surrounding a concave surface (520), the flat surface being in sliding contact with the D-valve plate (375) and the concave surface (520) facing the D-valve plate (375), the D-valve (370) being coupled via a lost motion interconnection (525) to the reduced diameter section (480) of the spool valve (360), the D-valve (370) being shiftable with the spool valve (360) between first and second positions corresponding to the respective first and second positions of the spool valve (360), wherein the D-valve (370) uncovers the first D-valve port (455) when the D-valve (370) is in the first position to introduce motive fluid into the upper chamber (635), the concave surface (520) of the D-valve (370) placing the second D-valve port (460) in communication with the D-valve exhaust port (465) to place the lower chamber (640) in communication with the atmosphere when the D-valve (370) is in the first position, wherein the D-valve (370) uncovers the second D-valve port (460) when the D-valve (370) is in the second position to introduce motive fluid into the lower chamber (640), the concave surface (520) of the D-valve (370) placing the first D-valve port (455) in communication with the D-valve exhaust port (465) to place the upper chamber (635) in communication with the atmosphere when the D-valve (370) is in the second position;

a pilot valve plate (385) including a first pilot port (470) communicating with the pilot chamber portion (515) and a second pilot port (475) communicating with atmosphere;

a pilot valve (380) having a flat surface surrounding a concave surface (530), the flat surface being in sliding contact with the pilot valve plate (385) and the concave surface (530) facing the pilot valve plate (385), the pilot valve (380) being coupled to the reduced diameter section (480) of the spool valve (360), the pilot valve (380) being shiftable with the spool valve (360) between first and second positions corresponding to the respective first and second positions of the spool valve (360), wherein the pilot valve (380) uncovers the first pilot port (470) when the pilot valve (380) is in the first position to introduce motive fluid into the pilot chamber (515), and wherein the concave surface (530) of the pilot valve (380) places the first and second pilot ports (470, 475) in communication with each other to place the pilot chamber (515) in communication with the atmosphere when the pilot valve (380) is in the second position, wherein introduction of motive fluid into the pilot chamber (515) shifts the spool valve (360) to the first position, wherein exposing the pilot chamber (515) to atmosphere facilitates shifting the spool valve (360) to the second position;

an actuation rod (625) having a first end (650) and a second end (660) opposite the first end (650), the first end (650) being interconnected by way of a lost motion connection (490, 655) to the spool valve (360), the second end (660) being interconnected by way of a lost motion connection (725, 665) to the piston (620), such that upward movement of the piston (620) assists the spool valve (360) moving from the second position toward the first position, and such that downward movement of the piston (620) assists the spool valve (360) moving from the first position to the second position;

an output rod (710) interconnected for reciprocal movement with the piston (620) and adapted to perform work; and a pressure regulator assembly (210) adapted to be coupled to the motive fluid inlet (335), the pressure regulator assembly (210) having a housing (1225) containing an actuator assembly (1230), a ball valve assembly (1235), a bleed valve (1240), a first pressure adjustment assembly (1245), and a second adjustment assembly (1250), wherein the housing (1225) includes a motive fluid inlet port (1270), a pressure regulator outlet (1215), a bleed valve port (1275), an actuator support (1280), a pressure adjustment chamber (1285), and a ball valve chamber (1290), and wherein the pressure regulator assembly (210) includes at least one gauge that displays at least one measurement parameter.

2. A pump assembly comprising:

a motive fluid inlet (335) adapted to receive a flow of motive fluid;

a cylinder (615);

a piston (620) within the cylinder (615), the piston (620) dividing the cylinder (615) into an upper chamber (635) above the piston (620) and a lower chamber (640) below the piston (620);

a valve chamber (355) including a pilot chamber portion (515);

a spool valve (360) shiftable between first and second positions, the spool valve (360) including a reduced diameter section (480) and an enlarged diameter section (485), the enlarged diameter section (485) being exposed to the pilot chamber portion (515);

a D-valve plate (375) including a first D-valve port (455) communicating with the upper chamber (635), a second D-valve port (460) communicating with the lower chamber (640), and a D-valve exhaust port (465) communicating with atmosphere;

a D-valve (370) having a flat surface surrounding a concave surface (520), the flat surface being in sliding contact with the D-valve plate (375) and the concave surface (520) facing the D-valve plate (375), the D-valve (370) being coupled via a lost motion interconnection (525) to the reduced diameter section (480) of the spool valve (360), the D-valve (370) being shiftable with the spool valve (360) between first and second positions corresponding to the respective first and second positions of the spool valve (360), wherein the D-valve (370) uncovers the first D-valve port (455) when the D-valve (370) is in the first position to introduce motive fluid into the upper chamber (635), the concave surface (520) of the D-valve (370) placing the second D-valve port (460) in communication with the D-valve exhaust port (465) to place the lower chamber (640) in communication with the atmosphere when the D-valve (370) is in the first position, wherein the D-valve (370) uncovers the second D-valve port (460) when the D-valve (370) is in the second position to introduce motive fluid into the lower chamber (640), the concave surface (520) of the D-valve (370) placing the first D-valve port (455) in communication with the D-valve exhaust port (465) to place the upper chamber (635) in communication with the atmosphere when the D-valve (370) is in the second position;

a pilot valve plate (385) including a first pilot port (470) communicating with the pilot chamber portion (515) and a second pilot port (475) communicating with atmosphere;

a pilot valve (380) having a flat surface surrounding a concave surface (530), the flat surface being in sliding contact with the pilot valve plate (385) and the concave surface (530) facing the pilot valve plate (385), the pilot valve (380) being coupled to the reduced diameter section (480) of the spool valve (360), the pilot valve (380) being shiftable with the spool valve (360) between first and second positions corresponding to the respective first and second positions of the spool valve (360), wherein the pilot valve (380) uncovers the first pilot port (470) when the pilot valve (380) is in the first position to introduce motive fluid into the pilot chamber (515), and wherein the concave surface (530) of the pilot valve (380) places the first and second pilot ports (470, 475) in communication with each other to place the pilot chamber (515) in communication with the atmosphere when the pilot valve (380) is in the second position, wherein introduction of motive fluid into the pilot chamber (515) shifts the spool valve (360) to the first position, wherein exposing the pilot chamber (515) to atmosphere facilitates shifting the spool valve (360) to the second position;

an actuation rod (625) having a first end (650) and a second end (660) opposite the first end (650), the first end (650) being interconnected by way of a lost motion connection (490, 655) to the spool valve (360), the second end (660) being interconnected by way of a lost motion connection (725, 665) to the piston (620), such that upward movement of the piston (620) assists the spool valve (360) moving from the second position toward the first position, and such that downward movement of the piston (620) assists the spool valve (360) moving from the first position to the second position;

an output rod (710) interconnected for reciprocal movement with the piston (620);

a piston pump (120) including a pump cylinder (170), an outlet (175), and a one-way valve supported for reciprocation within the pump cylinder (170) and operable to move fluid from below the one-way valve toward the outlet (175), the one-way valve being interconnected with the output rod (710) to cause reciprocation of the one-way valve to move a fluid to be pumped from within the cylinder (170) out the outlet (175) to a desired destination; and a pressure regulator assembly (210) adapted to be coupled to the motive fluid inlet (335), the pressure regulator assembly (210) having a housing (1225) containing an actuator assembly (1230), a ball valve assembly (1235), a bleed valve (1240), a first pressure adjustment assembly (1245), and a second adjustment assembly (1250), wherein the housing (1225) includes a motive fluid inlet port (1270), a pressure regulator outlet (1215), a bleed valve port (1275), an actuator support (1280), a pressure adjustment chamber (1285), and a ball valve chamber (1290), and wherein the pressure regulator assembly (210) includes at least one gauge that displays at least one measurement parameter.

3. The pump assembly of claim 2, further comprising a manifold cover (315) adjacent a surface of the D-valve plate (375) opposite a surface against which the D-valve flat surface slides, the manifold cover (315) including an upper chamber port (410) extending along a first axis, the upper chamber port (410) communicating with the first D-valve port (455).

4. The pump assembly of claim 3, further comprising a top plate (610) mounted on the cylinder (615) and defining a top end of the upper chamber (635), the top plate (610) including a top plate port (648) extending along a second axis, wherein the second axis is non-collinear with the first axis.

5. The pump assembly of claim 4, further comprising a drop tube (425) communicating between the upper chamber port (410) and the top plate port (648) and extending along a third axis, wherein the third axis is substantially collinear with the second axis.

6. The pump assembly of claim 5, wherein the drop tube (425) has a substantially constant internal diameter.

7. The pump assembly of claim 5, further comprising a first seal positioned between the drop tube (425) and the manifold cover (315) and a second seal positioned between the drop tube (425) and the top plate (610).

8. The air motor of claim 1, further comprising a manifold cover (315) adjacent a surface of the D-valve plate (375) opposite a surface against which the D-valve flat surface slides, the manifold cover (315) including an upper chamber port (410) extending along a first axis, the upper chamber port (410) communicating with the first D-valve port (455).

9. The air motor of claim 8, further comprising a top plate (610) mounted on the cylinder (615) and defining a top end of the upper chamber (635), the top plate (610) including a top plate port (648) extending along a second axis, wherein the second axis is non-collinear with the first axis.

10. The air motor of claim 9, further comprising a drop tube (425) communicating between the upper chamber port (410) and the top plate port (648) and extending along a third axis, wherein the third axis is substantially collinear with the second axis.

11. The air motor of claim 10, wherein the drop tube (425) has a substantially constant internal diameter.

12. The air motor of claim 10, further comprising a first seal positioned between the drop tube (425) and the manifold cover (315) and a second seal positioned between the drop tube (425) and the top plate (610).

* * * * *